US005379600A

United States Patent [19]

Moritsu et al.

[11] Patent Number: 5,379,600

[45] Date of Patent: Jan. 10, 1995

[54] SUPERCONDUCTING MAGNET AND METHOD FOR ASSEMBLING THE SAME

[75] Inventors: Kazuki Moritsu; Takahiro Matsumoto; Mitsuo Horikawa; Shuichi Nakagawa, all of Ako; Hideto Yoshimura, Amagasaki; Masashi Nagao, Amagasaki; Takashi Inaguchi, Amagasaki, all of Japan

[73] Assignee: Mitsubishi Denki Kabushiki Kaisha, Tokyo, Japan

[21] Appl. No.: 37,455

[22] Filed: Mar. 26, 1993

[30] Foreign Application Priority Data

Mar. 27, 1992 [JP] Japan ..... 4-070922

[51] Int. Cl.[6] ..... F17C 5/02

[52] U.S. Cl. ..... 62/47.1; 62/51.1; 505/892

[58] Field of Search ..... 62/47.1, 51.1, 468; 505/892

[56] References Cited

U.S. PATENT DOCUMENTS

| | | | |
|---|---|---|---|
| 4,535,596 | 8/1985 | Laskaris | 62/51.1 |
| 4,693,736 | 9/1987 | Klusmeir | 62/468 |
| 4,897,226 | 1/1990 | Hoyle et al. | 62/47.1 |
| 5,092,130 | 3/1992 | Nagao et al. | 62/6 |
| 5,144,810 | 9/1992 | Nagao et al. | 62/471 |

FOREIGN PATENT DOCUMENTS

| | | |
|---|---|---|
| 3427601 | 2/1985 | Germany . |
| 3739070 | 5/1988 | Germany . |
| 4020593 | 1/1991 | Germany . |
| 60-28211 | 2/1985 | Japan . |
| 63-164205 | 7/1988 | Japan . |
| 2233750 | 1/1991 | United Kingdom . |

*Primary Examiner*—Ronald C. Capossela
*Attorney, Agent, or Firm*—Sughrue, Mion, Zinn, Macpeak & Seas

[57] ABSTRACT

A superconducting magnet which is capable of improving the refrigerating and the assembling characteristics and of composing in small size. A helium vessel 2 contains a cylindrical superconducting coil for cryogenically refrigerating it by liquid helium. A second and a first heat-shields 5 and 6 and a vacuum vessel 4 are coaxially provided so as to surround the helium vessel 2. Over the helium vessel 2, a L-letter shaped duct 50 is provided to be exposed to helium gas atmosphere being evaporated in the helium vessel 2. A refrigerator-mounting cylinder 51 has an end coupled to the L-letter shaped duct 50 through the bellows 52 and is mounted on an end surface of the vacuum vessel 4 substantially in parallel to the axial direction of the superconducting coil. A three-stage cold heat accumulation refrigerator 30 is inserted into and fixed to the refrigerator-mounting cylinder 51 for reliquefying the helium gas having been drawn into the L-letter shaped duct 50 by a third heat stage 43.

21 Claims, 17 Drawing Sheets

SUPERCONDUCTING MAGNET AND METHOD FOR ASSEMBLING THE SAME

BACKGROUND OF THE INVENTION

1. Field of the Invention

The present invention relates to a superconducting magnet comprising a refrigerator, and more particularly to a structure of a superconducting magnet capable of enhancing a refrigerating and assembling properties and of being composed in small size.

2. Description of the Related Art

FIG. 18 is a cross-sectional view showing an example of a conventional superconducting magnet. In FIG. 18, the numeral 1 designates a superconducting coil which is impregnated in a liquid helium 3 as a cryogenic refrigerant being filled in a helium vessel 2 as a cryogenic refrigerant vessel. The numeral 4 designates a vacuum vessel provided to surround the helium vessel 2 and vacuums the space between the vacuum vessel 4 and the helium vessel 2 for heat insulation.

The numerals 5 and 6 designate a second and a first heat-shields respectively, which are mounted in coaxial cylindrical form so as to surround the helium vessel 2 between the helium vessel 2 and the vacuum vessel 4, thereby reducing the heat invasion into the helium vessel 2.

The numeral 7 designates a liquid nitrogen recipient provided in a part of the second heat-shield 6 for storing a liquid nitrogen 8.

The numeral 9 designates e.g. a Gihord Macmahon-type two-stage refrigerator including a first heat stage 10 of an absolute temperature 80 K. and a second heat stage 11 of 20 K. This refrigerator 9 is mounted vertically with respect to the axial direction of the magnet from upper side, and the first and the second heat stages 10 and 11 refrigerate respectively the first and the second heat-shield 6 and 5.

The numeral 13 designates a boat portion for injecting the liquid helium 3 and inserting a current lead for energizing the superconducting coil 1. The numeral 14 designates a constant temperature bore.

The refrigerator 9 used in the above-mentioned conventional superconducting magnet will now be described.

The refrigerator 9 is composed such that: a first-stage displacer 16 and a second-stage displacer 17 are slidably mounted in a cylinder 15 made of honing pipe and formed in two-stage; a first-stage seal 18 and a second-stage seal 19 for preventing any leakage of the helium gas are provided between the cylinder 15 and the first-stage displacer 16 and between the cylinder 15 and the second-stage displacer 17 respectively; and the first heat stage 10 and the second heat stage 11 are provided at the respective stage outer peripheral surface.

The first-stage displacer is provided with a first-stage cool heat accumulator 20 made by use of copper wire netting as a cool heat member, and the second-stage displacer 17 is provided with a second-stage cool heat accumulator 21 made by use of lead ball.

Further, the refrigerator 9 includes a helium compressor 25 for compressing helium gas 24 and gas ducts including an induction valve 26 and an exhaust valve 27 for inducing and exhausting the helium gas 24, and further includes a drive motor 28 for reciprocating the first and the second-stage displacers 16 and 17 in the cylinder 15 and driving the induction valve 26 and the exhaust valve 27 in synchronicity with the reciprocation.

The refrigerator composed as mentioned above will be operated in the following manner.

Firstly, in such a state as the first and the second-stage displacers 16 and 17 being at the lowest end and the induction valve 26 being opened and the exhaust valve 27 being closed, and the high-pressure helium gas 24 compressed by the helium compressor 25 is introduced into first and second-stage expansion chamber 22 and 23 and set in high-pressure state.

Next, the first and the second-stage displacers 16 and 17 moves upwardly, and in accordance therewith the high-pressure helium gas 24 is introduced into the first and the second-stage expansion chamber 22 and 23 through the first and the second-stage cool heat accumulators 20 and 21. During this operation, the induction valve 26 and the exhaust valve 27 does not move. The high-pressure helium gas 24 is refrigerated to a predetermined temperature by the cold heat member when passing through the first and the second-stage cool heat accumulators 20 and 21.

Subsequently, by the downward movement of the first and second-stage displacers 16 and 17, the low temperature/low pressure helium gas 24 pass through the first and the second-stage cool heat accumulators 20 and 21 to be exhausted through the exhaust valve 27. Then the low temperature/low pressure helium gas 24 refrigerates the cool heat member of the first and second-stage cool heat accumulator 20 and 21, and thereafter returns to the helium compressor 25. The exhaust valve 27 closes while the induction valve 26 opens, and the high-pressure helium gas 24 having been compressed by the helium compressor 25 is introduced, and the pressures in the first and the second-stage expansion chambers 22 and 23 changes from low-pressure state to high-pressure state.

Thus, by repeating the aforementioned operations, the first and the second-stage heat stages 10 and 11 are refrigerated to temperatures of 80 K. and 20 K. respectively.

Subsequently, the operation of the aforementioned conventional superconducting magnet will now be described.

The first heat shield 6 is refrigerated to 80 K. by the first heat stage of the refrigerator 9 and the liquid nitrogen 8 contained in the liquid nitrogen recipient 7. The second heat-shield 5 is refrigerated to 20 K. by the second heat stage 11 of the refrigerator 9. Any invading heat from outside is vacuum-insulated by the vacuum vessel 4 and is further shut by the first and the second heat-shields 6 and 5 so as to reduce the heat invasion into the helium vessel 2.

The superconducting coil 1 is cryogenically refrigerated (e.g. 4.2 K.) by the liquid helium 3 in the helium vessel 2 to hold its superconducting state, and receives energizing current from an external superconducting magnet power source (not shown) through a current lead (not shown) to generate a required magnetic field.

However, the aforementioned conventional superconducting magnet is a lateral hollow magnet and the refrigerator 9 is mounted vertically with respect to the axial direction of the magnet. Therefore, it is necessary to ensure a sufficient length for the reciprocating movement of the piston called displacer for achieving the refrigerating property of the refrigerator 9 and to establish a large space between the first heat-shield 6 and the second heat-shield 5 and the space between the vacuum vessel 4 and the first heat-shield 6, thereby increasing the height and the total size of the arrangement.

To cope with such problems, the following superconducting magnet is proposed.

FIG. 19 is a cross-sectional view showing another example of the conventional superconducting magnet disclosed in, for example, Japanese Patent Laid-Open No. Sho 63-164205. In this conventional superconducting magnet shown in FIG. 19, the refrigerator 9 is provided in parallel to the axial direction of the magnet over the vacuum vessel 4, and the first heat stage 10 and the second heat stage 11 are coupled through copper plates etc. to the first heat-shield 6 and the second heat-shield 5 respectively.

The conventional superconducting magnet thus composed has a smaller radial dimension by arranging such that the reciprocating direction of the dimensionally longest first and second-stage displacers 16 and 17 of the refrigerator 9 is in parallel to the axial direction of the magnet.

According to the conventional superconducting magnet, as mentioned above, since the refrigerator 9 is mounted vertically with respect to the axial direction of the magnet, the height of the magnet device is increased and the entire system becomes in large size.

Further, in the conventional superconducting magnet coping with such problems, although the radial dimension of the magnet device is reduced by arranging the refrigerator 9 in parallel to the axial direction of the magnet over the vacuum vessel 4, the helium vessel 2 cannot be directly refrigerated and the helium gas being evaporated from the liquid helium 3 due to the fact that the refrigerator 9 includes the first heat stage 10 of 80 K. and the second heat stage 11 of 20 K.

SUMMARY OF THE INVENTION

It is therefore an object of this invention to provide a superconducting magnet capable of reducing the radial dimension of the magnet device for smaller size and of reliquefying the helium gas.

A superconducting magnet of the present invention comprising: a superconducting coil; a cryogenic refrigerant vessel containing a cryogenic refrigerant for refrigerating the superconducting coil; a heat-shield surrounding the cryogenic refrigerant vessel; and a vacuum vessel surrounding the heat-shield; wherein at least a part of a heat stage is exposed to an atmosphere of cryogenic refrigerant gas being evaporated in the cryogenic refrigerant vessel; and a multi-stage cold heat accumulation refrigerator for reliquefying the cryogenic refrigerant gas is removably mounted substantially in horizontal state on said vacuum vessel.

A superconducting magnet of the present invention comprising: a superconducting coil; a cryogenic refrigerant vessel containing a cryogenic refrigerant for refrigerating the superconducting coil; a heat-shield surrounding the cryogenic refrigerant vessel; and a vacuum vessel surrounding the heat-shield; wherein at least a part of heat stages is exposed to an atmosphere of cryogenic refrigerant gas being evaporated in said cryogenic refrigerant vessel; and a multistage cold heat accumulation refrigerator for reliquefying the cryogenic refrigerant gas is removably mounted substantially in horizontal state on said vacuum vessel.

A superconducting magnet of the present invention comprising: a superconducting coil; a cryogenic refrigerant vessel containing a cryogenic refrigerant for refrigerating the superconducting coil; a heat-shield surrounding the cryogenic refrigerant vessel; and a vacuum vessel surrounding the heat-shield; wherein the cyrogenic refrigerant vessel is provided with a drawing portion having an end exposed to an atmosphere of cryogenic refrigerant gas being evaporated in the cryogenic refrigerant vessel; at least a part of heat stages is exposed to the drawing portion; and a multistage cold heat accumulation refrigerator for reliquefying the cryogenic refrigerant gas being drawn into the drawing portion is mounted substantially in horizontal state on the vacuum vessel.

A superconducting magnet of the present invention comprising: a superconducting coil; a cryogenic refrigerant vessel containing a cryogenic refrigerant for cooling the superconducting coil; a heat-shield surrounding the cryogenic refrigerant vessel; and a vacuum vessel surrounding the heat-shield; wherein a multistage cold heat accumulation refrigerator for refrigerating the cryogenic refrigerant vessel by at least a part of a heat stage thereof is mounted substantially in horizontal state in the vacuum vessel.

A superconducting magnet of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat shield; and a multistage cold heat accumulation refrigerator for reliquefying a cryogenic refrigerant gas in the cryogenic refrigerant vessel by at least a part of heat stages thereof; where the multistage heat accumulation refrigerator is mounted substantially in horizontal state at an end surface of the vacuum vessel.

A superconducting magnet of the present invention comprising: a superconducting coil; a cryogenic refrigerant vessel containing a cryogenic refrigerant for cooling the superconducting coil; a second heat-shield surrounding the cryogenic refrigerant vessel; a first heat-shield surrounding the second heat-shield; a vacuum vessel surrounding the first heat-shield; a refrigerator-mounting cylinder provided in the vacuum vessel; and a multistage cold heat accumulation refrigerator being inserted into and fixed to the refrigerator-mounting cylinder such that each heat stage thermally contacts with the refrigerator-mounting cylinder; wherein a second notch is formed in the second heat-shield; a first notch portion for exposing the second notch is formed in the first heat-shield; the first notch thermally contacts with the refrigerator-mounting cylinder with the first heat-shield through a flexible conductor; and the second notch thermally contacts the refrigerator-mounting cylinder with said second heat-shield through a flexible conductor.

A superconducting magnet of the present invention comprising: a superconducting coil; a cryogenic refrigerant vessel containing a cryogenic refrigerant for refrigerating the superconducting coil; a second heat-shield surrounidng the cryogenic refrigerant vessel; a first heat-shield surrounding the second heat-shield; a vacuum vessel surrounding the first heat-shield; a refrigerator-mounitng cylinder provided in the vacuum vessel; and a multistage cold heat accumulation refrigerator inserted into and fixed to the refrigerator-mounting cylinder such that a part of heat stages thereof thermally contacts with the refrigerator-mounting cylinder; wherein a second notch is formed in the second heat-shield; a first notch is formed in the first heat-shield to expose the second notch; a radiation cover for sealing the first and second notch is provided; the refrigerator-mounting cylinder and the first heat-shield are thermally coupled through a flexible conductor at the first notch; the refrigerator-mounting cylinder and the second heat-shield are thermally coupled through a flexible conductor at the second notch; and the first and second notches are sealed by the radiation cover.

A superconducting coil of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat-shield; a refrigerator-mounting cylinder having an end being exposed to an atmosphere of a cryogenic refrigerant gas being evaporated in the cryogenic refrigerant vessel and the other end being mounted in substantially horizontal state on said vacuum vessel; and a multistage cold heat accumulation refrigerator having heat stages at least a part of which reliquefies the cryogenic refrigerant gas having been drawn into the refrigerator-mounting cylinder; wherein a thermally insulating filler is filled in a space between the multistage cold heat accumulation refrigerator and the refriterator-mounting cyclinder.

A superconducting magnet of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat-shield; a refrigerator-mounting cylinder having one end being exposed to an atmosphere of the cryogenic refrigerant gas being exposed to an atmosphere of the cryogenic refrigerant gas being evaporated in the cryogenic refrigerant vessel and the other end being mounted substantially in horizontal state on the vacuum vessel; and a multistage cold heat accumulation refrigerator inserted into and fixed to the refrigerator-mounting cylinder and having heat stages at least a part of which reliquefies the cryogenic refrigerant gas having been drawn into the refrigerator-mounting cylinder; wherein a thermally insulating filler to be filled in a space between the multistage cold heat accumulation refrigerator and the refrigerator-mounting cylinder is attached to the multistage cold heat accumulation refrigerator.

A superconducting coil of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat-shield, a multistage heat accumulation refrigerator composed of: a multistage cylinder having a plurality of heat stages; and a multistage displacer slidably mounted in the cylinder; and a refrigerator-mounting cylinder mounted on the vacuum vessel for holding the multistage heat accumulation refrigerator having been inserted thereinto; wherein a refrigerator-side thermal conductor having a tapered surface is provided in each of the heat stages of the multistage heat accumulation refrigerator; a cylinder-side thermal conductor is having a tapered surface is provided at an inner wall surface of the refrigerator-mounting cylinder being opposed to the refrigerator-side thermal conductor; and a soft metal is held between the refrigerator-side thermal conductor and the cylinder-side thermal conductor.

A superconducting coil of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat-shield; a multistage cryogenic refrigerant refrigerator composed of: a multistage cylinder having a plurality of heat stages; and a multistage displacer slidably mounted in the cylinder; and a refrigerator-mounting cylinder mounted in the vacuum vessel for holding the multistage cold heat accumulation refrigerator being inserted thereinto; wherein a refrigerator-side side elastic thermal conductor is provided at each heat stage of the multistage cold heat accumulation refrigerator: a cylinder-side thermal conductor is provided at an inner wall surface of the refrigerator-mounting cylinder being opposed to the refrigerator-side elastic thermal conductor; and a soft metal is held between the refrigerator-side elastic thermal conductor and the cylinder-side thermal conductor.

A superconducting magnet of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat-shield; a multistage cold heat accumulation refrigerator composed of: a multistage cylinder having a plurality of heat stages; and a multistage displacer slidably mounted in the cylinder; and a refrigerator-mounting cylinder mounted in the vacuum vessel for holding the multistage cold heat accumulation refrigerator having been inserted thereinto; wherein a refrigerator-side thermal conductor having a knurled tapered surface at each of the heat stages of the multistage cold heat accumulation refrigerator; a cylinder-side thermal conductor having a tapered surface is provided at the inner wall surface of the refrigerator-mounting cylinder opposed to the refrigerator-side thermal conductor; and a soft metal is held between the refrigerator-side thermal conductor and the cylinder-side thermal conductor.

A superducting magnet of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat-shield; a multistage cold heat accumulation refrigerator having a flang portion; and a refrigerator-mounting cylinder having a mounting flange portion; wherein an air-tight seal member is provided between an inner periphery surface of the mounting-flange portion and an outer periphery surface of the flange portion; the flange portion is screwed through an elastic member to the mounting flange; and the multistage cold heat accumulation refrigerator is elastically and slidably held on the refrigerator-mounting cylinder.

A superconducting magnet of the present invention comprising: a superconducting coil; a cryogenic refrigerant vessel containing a cryogenic refrigerant for cooling the superconducting coil; a heat-shield surrounding the cryogenic refrigerant vessel; a vacuum vessel surrounding the heat shield; and a multistage cold heat accumulation refrigerator having heat stages at least a part of which is exposed to an atmosphere of a cryogenic refrigerant gas being evaporated in the cryogenic refrigerant vessel for reliquefying the cryogenic refrigerant gas; wherein an expanded heat transmitting surface is formed at the outer periphery surface of the heat stage for reliquefying the cryogenic refrigerant.

A superconducting magnet of the present invention comprising: a superconducting magnet; a cryogenic refrigerant vessel containing a cryogenic refrigerant for refrigerating the superconducting coil; a heat-shield surrounding said cryogenic refrigerant vessel; a vacuum vessel surrounding the heat shield; a drawing portion provided in the cryogenic refrigerant vessel and having an end to be exposed to an atmosphere of a cryogenic refrigerant gas being evaporated in the cryogenic refrigerant vessel; and a multistage cold heat accumulation refrigerator having a heat stage at least a part of which is exposed to said drawing portion for reliquefying the very low temperature coolant gas being drawn into the drawing portion; wherein at least a part of a heat accumulator of the multistage cold heat accumulation refrigerator is mounted in the drawing portion.

A superconducting magnet of the present invention comprising: a superconducting magnet; a cryogenic refrigerant vessel containing a cryogenic refrigerant for refrigerating the superconducting coil; a heat-shield surrounding the cryogenic refrigerant vessel; a vacuum vessel surrounding the heat-shield; a drawing portion provided in the cryogenic refrigerant vessel and having an end to be exposed to an atmosphere of a cryogenic refrigerant gas being evaporated in the cryogenic refrigerant vessel; and a multistage cold heat accumulation refrigerator having heat stages at least a part of which is exposed to the drawing portion for reliquefying the cryogenic refrigerant gas being drawn into the drawing portion; wherein a hollow cylindrical magnetic shield made of magnetic member is mounted to support outer side of the drawing portion to surround a part of the cool heat accumulator of the multistage cold heat accumulation refrigerator.

A superconducting magnet comprising: a superconducting magnet; a cryogenic refrigerant vessel containing a cryogenic refrigerant for refrigerating the superconducting coil; a heat-shield surrounding the cryogenic refrigerant vessel; a vacuum vessel surrounding the heat shield; a refrigerator-mounting cylinder having an end being exposed to an atmosphere of a cryogenic refrigerant gas being evaporated in the cryogenic refrigerant vessel and the other end being mounted in the vacuum vessel in substantially horizontal state; and a multistage cold heat accumulation refrigerator being inserted into and fixed to the refrigerator-mounting cylinder and having heat stages at least a part of which reliquefies the cryogenic refrigerant gas being drawn into the refrigerator-mounting cylinder; wherein a thermally insulating filler is filled in a space between the multistage heat accumulation refrigerator and the refrigerator-mounting cylinder so as to surround at least a part of a cold heat accumulator of the multistage cold heat accumulation refrigerator.

A method for assembling a superconducting magnet comprising: a superconducting coil; a cryogenic refrigerant vessel with a cryogenic refrigerant for cooling the superconducting coil; a heat-shield surrounding the cryogenic refrigerant vessel; a vacuum vessel surrounding the heat-shield; a refrigerator composed of a multistage cylinder having heat stages and a multistage displacer slidably provided in the cylinder; and a refrigerator-mounting cylinder mounted in the vacuum vessel for holding the refrigerator being inserted thereinto; wherein the refrigerator is inserted into the refrigerator-mounting cylinder; the refrigerator is screwed into and fixed to the refrigerator-mounting cylinder such that the heat stage and the refrigerator-mounting cylinder are thermally contacted; and the refrigerator is further tightly screwed into the refrigerator-mounting cylinder after the refrigerator is refrigerated.

A superconducting magnet of the present invention comprising: a superconducting coil; a cryogenic refrigerant vessel containing a cryogenic refrigerant for refrigerating the superconducting coil; a second heat-shield surrounding cryogenic refrigerant vessel; a first heat-shield surrounding the second heat-shield; a vacuum vessel surrounding the first heat-shield; and a three-stage heat accumulation refrigerator mounted substantially in horizontal state; wherein the three-stage cold heat accumulation refrigerator has a refrigerating capacity of: reaching temperature of a first heat stage, 50–80 K.; reaching temperature of a second heat stage, 10–20 K.; and a reaching temperature of a third heat stage, 2–4.5 K.; the first and second heat-shields are refrigerated at the first and second heat stages respectively; and the cryogenic refrigerant gas being evaporated in the cryogenic refrigerant vessel is reliquefied at the third heat stage.

A superconducting magnet of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat-shield; and a refrigerator for refrigerating the heat-shield; wherein a pressure difference detecting means for detecting a difference between a pressure in the cryogenic refrigerant vessel and an atmospheric pressure; and the difference pressure is controlled to be 0–0.5 Kg/m.

A superconducting magnet of the present invention comprising: a superconducting coil; a cryogenic refrigerant vessel containing a cryogenic refrigerant for refrigerating said superconducting coil; a heat-shield surrounding the cryogenic refrigerant vessel; a vacuum vessel surrounding the heat-shield; and a refrigerator for refrigerating the heat-shield; wherein a pressure detecting means for detecting an absolute pressure in the cryogenic refrigerant vessel; and the absolute pressure is controlled to be 1–1.5 Kg/cm.

A superconducting magnet of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat-shield; a helium gas compressing means provided at a constant temperature portion; and a refrigerator for making the helium gas compressed by the helium gas compressing means be operating fluid for refrigerating the heat-shield; wherein the helium gas compressing means is composed of: a low pressure shell; a scroll compressor provided in the low pressure shell; a refrigerating means for refrigerating high-pressure helium gas being output from the scroll compressor; an oil separator for eliminating oil components contained in the high-pressure helium gas refrigerated in the refrigerating member; an adsorber for adsorbing the oil components contained in the high-pressure helium gas output from the oil separator; a gas supply duct for supplying the high-pressure helium gas output from the adsorber to the refrigerator; a gas return duct for returning low-pressure helium gas from the refrigerator to the low-pressure shell; and an oil injection circuit for injecting the oil injection circuit for injecting the oil separated by the oil separator into an intermediate pressure boat of the scroll compressor;

A superconducting magnet of the present invention comprising: a superconducting coil; a cryogenic refrigerant vessel containing a cryogenic refrigerant for refrigerating the superconducting coil; a heat-shield surrounding the cryogenic refrigerant vessel; a vacuum vessel surrounding the heat-shield; a helium gas compressing means provided at a constant temperature portion; and a refrigerator for making the helium gas compressed by the helium gas compressing means be operating fluid for refrigerating the heat-shield; wherein the helium gas compressing means is composed of: a low-pressure shell; a scroll compressor provided in the low-pressure shell; a refrigerating means for refrigerating high-pressure helium gas being output from the scroll compressor; an oil separator for eliminating oil components contained in the high-pressure helium gas refrigerated in said refrigerating member; a adsorber for adsorbing the oil components contained in the high-pressure helium gas output from the oil separator; a gas supply duct for supplying the high-pressure helium gas output from the adsorber to the refrigerator; a gas return duct for returning low-pressure helium gas from the refrigerator to the low pressure shell; and an oil return circuit for returning the oil separated in the oil separator to the gas return duct.

In the superconducting magnet of the present invention, the multistage cool accumulation refrigerator is mounted substantially in horizontal state on the vacuum vessel. As a result, it is possible to ensure a reciprocating moving amount of the displacer contributing to the refrigerating capacity of the multistage cool accumulation refrigerator without occupying too much the spaces between the vacuum vessel and the heat-shield and between the heat-shield and the cryogenic refrigerant vessel, to reduce the height of the arrangement and to make it in small size. Further, since the cryogenic refrigerant gas being evaporated in the cryogenic refrigerant vessel is reliquefied by a part of heat stages of the multistage cool heat accumulation refrigerator, the consumption of the cryogenic refrigerant can be reduced and the pressure in the cryogenic refrigerant vessel can be prevented from increasing for stable operation.

In the superconducting magnet of the present invention, since the multistage cold heat accumulation refrigerator is mounted substantially in horizontal state on the vacuum vessel, it is possible to remove the multistage cold heat accumulation refrigerator without decomposing the arrangement, thereby improving the maintenance property.

In the superconducting of the present invention, since the multistage cold heat accumulation refrigerator is provided such that a part of its heat stages is exposed into the drawing portion provided in the cryogenic refrigerant vessel and having an end to be exposed to the atmosphere of the cryogenic refrigerant gas being evaporated in the cryogenic refrigerant vessel, the cryogenic refrigerant gas can be efficiently reliquefied.

In the superconducting magnet of the present invention, since the cryogenic refrigerant vessel is refrigerated by at least a part of the heat stages of the multistage cold heat accumulation refrigerator, the cryogenic refrigerant gas being evaporated in the cryogenic refrigerant vessel is reliquefield and the consumption of the cryogenic refrigerant can be reduced, and further the pressure increase in the cryogenic refrigerant vessel can be prevented for stable operation.

In the superconducting magnet of the present invention, since the multistage cold heat accumulation refrigerator is mounted substantially in horizontal state at the end surface of the vacuum vessel, the height of the arrangement can be further reduced.

In the superconducting magnet of the present invention, since the second notch is formed in the second heat-shield and a first notch is formed in the first heat-shield to expose the second notch, it is possible, when the second heat-shield provided inside the first heat-shield and the refrigerator-mounting cylinder at the second notch are coupled through the flexible conductor, to couple the first heat-shield without disturbed by the first notch formed to expose the second notch, thereby increasing the assembling property.

In the superconducting magnet of the present invention, since the radiation cover for sealing the second notch formed in the second heat-shield and the first notch formed in the first heat-shield is provided, any external heat invasion can be reduced.

In the superconducting magnet of the present invention, since the thermally insulating filler is filled in the space between the multistage cold heat accumulation refrigerator and the refrigerator-mounting cylinder, the cryogenic refrigerant gas having been drawn from the cryogenic refrigerant vessel to the space between the multistage cold heat accumulation refrigerator and the refrigerator-mounting cylinder is heated at the high-temperature portion in accordance with the temperature difference arising in the multistage cylinder of the multistage cold heat accumulation refrigerator. As a result, the heat convection generated due to the refrigeration at the low-temperature portion and arising in the space between the multistage cold heat accumulation refrigerator and the refrigerator-mounting cylinder so as to improve the refrigerating efficiency of the multistage cold heat accumulation refrigerator.

In the superconducting magnet of the present invention, since the thermally insulating filler filled in a space between the multistage cold heat accumulation refrigerator and the refrigerator-mounting cylinder is adhered to the multistage cold heat accumulation refrigerator, it is possible to remove the thermally insulating filler together with the multistage cold heat accumulation refrigerator so as to enhance the maintenance property.

In the superconducting magnet of the present invention, since the soft metal is held between the refrigerator-side thermal conductor and the cylinder-side thermal conductor both having tapered surface, it is possible to ensure the thermal coupling between the refrigerator-side thermal conductor and the cylinder-side thermal conductor due to the plastic transformation of the soft metal.

In the superconducting magnet of the present invention, since the soft metal is held between the elastic refrigerator-side thermal conductor and the cylinder-side thermal conductor, any fluctuation of the positional relationship between the multistage cold heat accumulation refrigerator and the refrigerator-mounting cylinder due to the factors such as the heat or the vibration etc. can be absorbed by the refrigerator-side thermal conductor so as to ensure the thermal coupling between the refrigerator-side thermal conductor and the cylinder-side thermal conductor.

In the superconducting magnet of the present invention, since the tapered surface of the refrigerator-side thermal conductor is knurled, the contact force between the knurled tapered surface and the soft metal is increased, and it is possible to remove the soft metal having been broken due to the thermal coupling in the state of being adhered to the knurled tapered surface of the refrigerator-side thermal conductor, thereby simplifying the maintenance operation of the multistage cold heat accumulation refrigerator.

In the superconducting magnet of the present invention, since the air-tight seal member is provided in the space between the inner peripheral surface of the mounting flange portion and the outer peripheral portion of the flange portion and the flange portion is screwed through the elastic member into the mounting flange portion, the multistage cold heat accumulation refrigerator can be air-tightly and elastically held to be slidable on the refrigerator-mounting cylinder so as to absorb any fluctuation of the postional relationship between the multistage cold heat accumulation refrigerator and the refrigerator-mounting cylinder due to the factors such as the heat or the vibration etc., and to hold it more tightly by the bolt to ensure a predetermined screwing force.

In the superconducting magnet of the present invention, since the expanded heat transmitting surface is formed at the outer peripheral surface of the heat stages, the cryogenic refrigerant can be quickly dropped out through the expanded heat transmitting surface having been liquefied by the heat stages so as to make the cryogenic refrigerant liquid film at the outer peripheral surface of the heat stages thinner, thereby reducing the lowering of the heat transmitting rate through the cryogenic refrigerant liquid film and preventing the lowering of the refrigerating efficiency of the heat stages.

In the superconducting magnet of the present invention, since a plurality of magnetic rings are mounted on the drawing portion to surround at least a part of the cold heat accumulator of the multistage cold heat accumulation refrigerator with a predetermined interval, it is possible to prevent the plurality of magnetic rings from interfering with any external magnetic field, and to shut the heat conduction between the magnetic rings through the magnetic rings.

In the superconducting magnet of the present invention, since the hollow cylindrical magnetic shield made of magnetic material is supported at the outside of the drawing portion to surround at least a part of the cold heat accumulator of the multistage cold heat accumulation refrigerator, it is possible to prevent any heat invasion through the magnetic shield without interfering with the external magnetic field.

In the superconducting magnet of the present invention, since the thermally insulating filler made of magnetic foaming agent is filled in the space between the multistage cold heat accumulation refrigerator and the refrigerator-mounting cylinder so as to surround at least a part of the cold heat accumulator of the multistage cold heat accumulation refrigerator, it is possible to reduce the heat convection of the cryogenic refrigerant gas having been drawn from the cryogenic refrigerant vessel into the space between the multistage cold heat accumulation refrigerator and the refrigerator-mounting cylinder and to prevent any interference with the external magnetic field by the thermally insulating filler formed as a magnetic shield.

In the method for assembling a superconducting magnet of the present invention, since the refrigerator is inserted into the refrigerator-mounting cylinder, the refrigerator is screwed into and fixed to the refrigerator-mounting cylinder for make the heat stages thermally contact with the refrigerator-mounting cylinder, and after the refrigeration of the refrigerator the refrigerator is further tightly screwed to the refrigerator-mounting cylinder, the refrigerator is refrigerated and contracted after being screwed into and fixed to the refrigerator-mounting cylinder. As a result, even if the refrigerator-mounting cylinder and the heat stages are thermally separated, it is possible to keep the thermal coupling state by the further the screwing and fixing.

In the superconducting magnet of the present invention, since the three-stage cold heat accumulation refrigerator having the refrigerating capacity of: the reaching temperature of the first heat stage being 50–80 K.; the reaching temperature of the second heat stage being 10–20 K.; and the reaching temperature of the third heat stage being 2–4.5 K. is used, the first and the second heat-shields are refrigerated by the first and the second heat stages, and the cryogenic refrigerant gas being evaporated in the cryogenic refrigerant vessel is reliquefied by the third heat stage, the superconducing magnet can be stably operated.

In the superconducting magnet of the present invention, since a difference pressure detecting means for detecting a difference pressure between the pressure in the cryogenic refrigerant vessel and the atmospheric pressure is provided, and the difference pressure is controlled to be 0–0.5 Kg/cm, it is possible to prevent any inhalation of external air so as to eliminate the necessity of high-pressure design, and the fluctuation of the magnetic field can be reduced by suppressing the deformation of the recipient.

In the superconducting magnet of the present invention, since the pressure detecting means for detecting the absolute pressure in the cryogenic refrigerant vessel is provided, and the absolute pressure is controlled to be 1–1.5 Kg/cm, it is possible to prevent any inhalation of external air so as to eliminate the necessity of high-pressure design, and the fluctuation of the magnetic field can be reduced by suppressing the deformation of the recipient.

In the superconducting magnet of the present invention, since the oil injection circuit for injecting oil having been separated by the helium gas compressing means in the oil separator into the intermediate pressure boat of the scroll compressor, it is possible to prevent any burning of the scroll compressor.

In the superconducting magnet of the present invention, since the oil return circuit for returning the oil having been separated by the helium gas compressor in the oil separator to the gas return duct is provided, the oil separated in the oil separator is separated from the high-pressure helium gas refrigerated by the refrigerating means so as to refrigerate the oil in the low-pressure shell.

DESCRIPTION OF THE PREFERRED EMBODIMENTS

A description will now be given of preferred embodiments of the present invention applied to superconducting magnet devices for magnetic resonance image diagnostic apparatus.

Embodiment 1

This embodiment is to carry out the aspects 1 to 3, 5 to 10 and 19 of the present invention.

Figure 1:
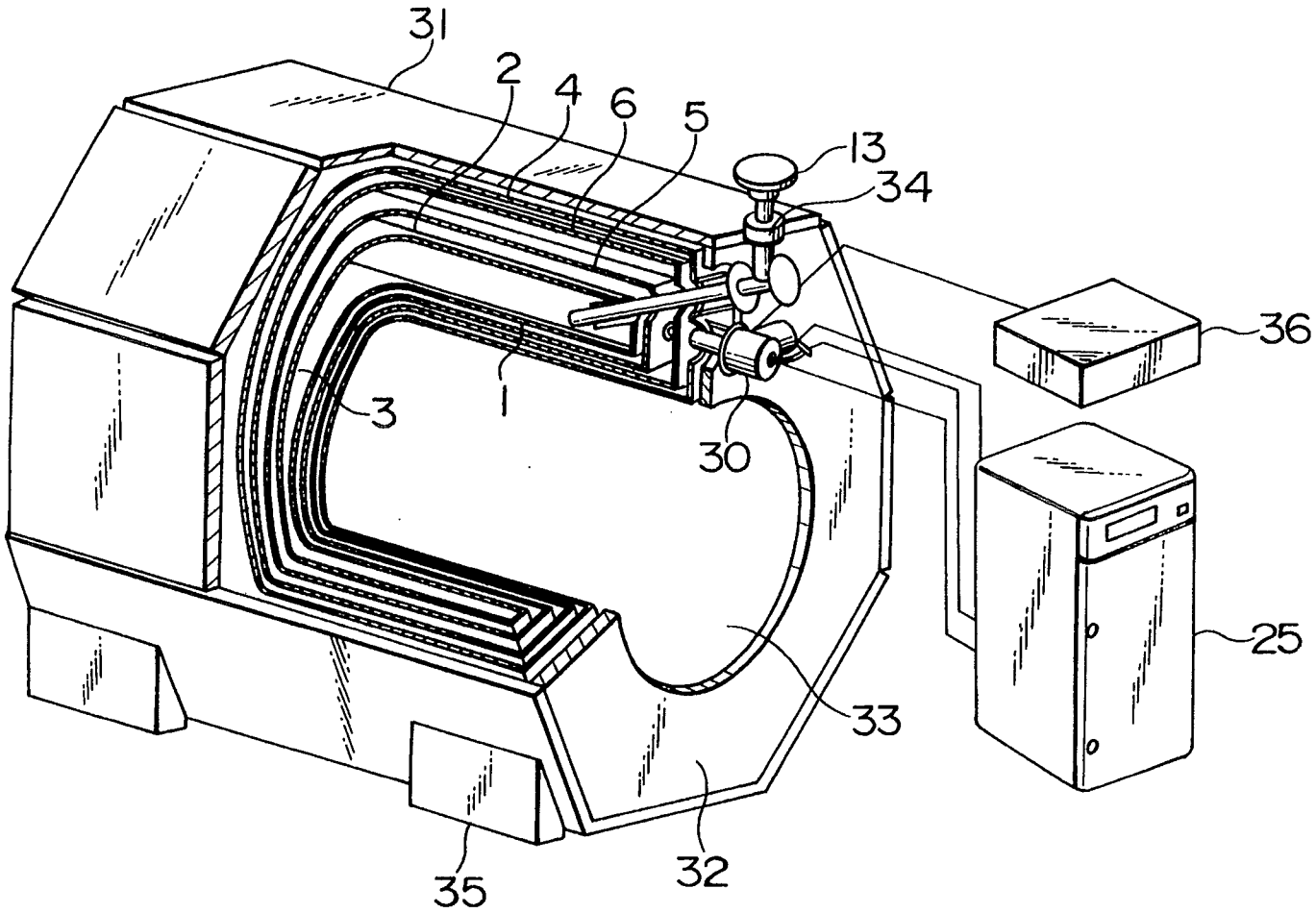
FIG. 1 is a partially cut-out perspective view of a superconducting magnet showing a first embodiment of the present invention.
Figure 19:
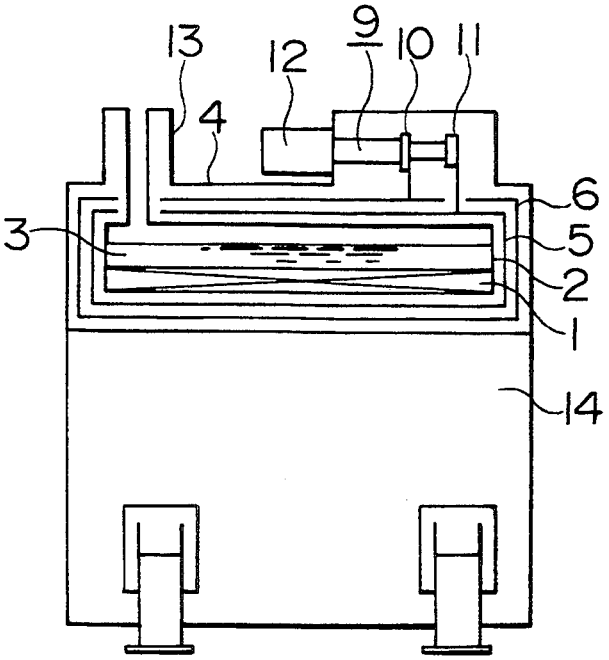
FIG. 19 is a cross-sectional view showing another example of the conventional superconducting magnet.
Figure 20:
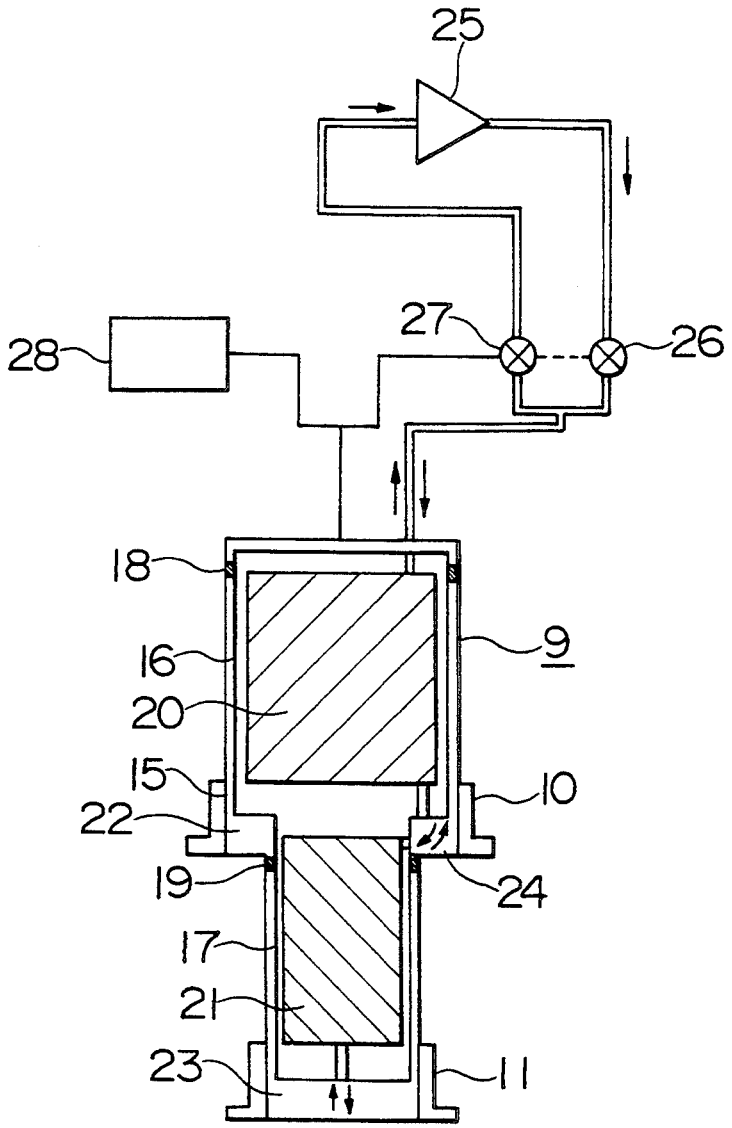
FIG. 20 is a schematic cross-sectional view showing an example of a two-stage cold heat accumulation refrigerator in the conventional superconducting magnet.

FIG. 1 is a partly-sectioned perspective view of a superconducting magnet as the first embodiment. In this Figure, the same reference numerals are used to denote the same parts or components as those used in the known devices shown in FIGS. 19 to 20, and detailed description of such parts or components is omitted.

Referring to these Figures, numeral 30 designates a three-staged cold heat accumulation refrigerator which is connected to an end of a vacuum vessel 4 substantially in parallel with the axis of the superconducting coil 1. Numeral 31 designates an iron magnetic shield which is made of iron and which surrounds the vacuum vessel 4 together with a magnetic shield flange 32 which also is made of iron. Numeral 33 designates a bore, 34 denotes a pressure relief valve mounted on the port section 13, 35 denotes a mounting leg for superconducting magnet 35 and 36 denotes a pressure controller unit which controls the internal pressure of the helium vessel 2.

In this first embodiment, the helium vessel 2 accommodating the superconducting coil 1, second heat shield 5, first heat shield 6 and the vacuum vessel 4 are arranged coaxially, thus forming a lateral hollow magnet.

Figure 2:
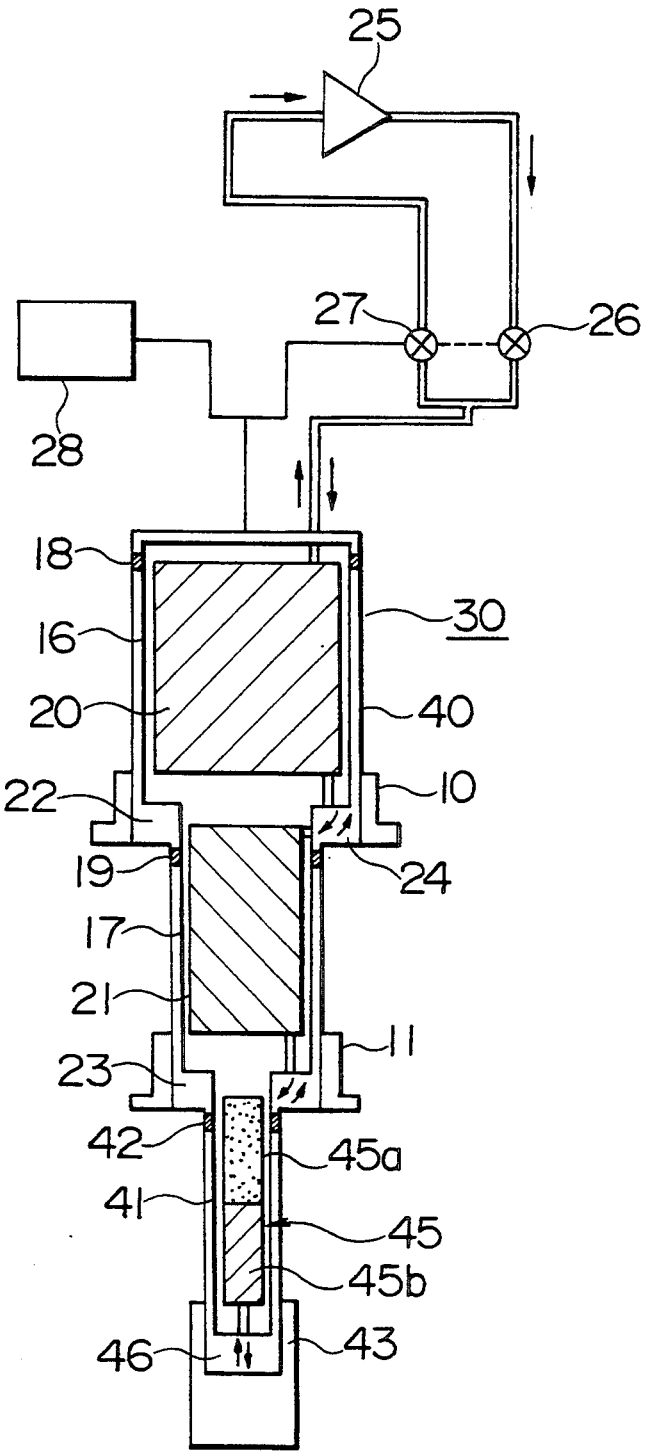
FIG. 2 is a schematic cross-sectional view of three-stage cold heat accumulation refrigerator in a superconducting magnet showing a first embodiment o the present invention.

A detailed description will now be given of the three-staged cold-heat accumulation refrigerator which is employed in the superconducting magnet of the first embodiment, with specific reference to FIG. 2.

The three-staged cold-heat accumulation refrigerator 30 has a three-staged cylinder 40 which is formed of, for example, a honing pipe. The cylinder 40 slidably receives a first-stage displacer 16, a second-stage displacer 17 and a third-stage displacer 41. A first-stage seal 18, a second-stage seal 19 and a third-stage seal 42 for preventing leakage of the refrigerant are disposed between the wall of the cylinder 40 and the first-, second- and third-stage displacers 16, 17 and 18. Furthermore, a first heat stage 10, a second heat stage 11 and the third heat stage 43 are disposed on the outer peripheral surfaces of the respective stages of the cylinder 40.

The third-stage displacer 41 receives a third-stage cold-heat accumulator 45 which is composed of a high-temperature section 45*a* which employs a cold-heat accumulating member of GdRh having a large specific heat at 20 K. to 7.5 K. and a low-temperature section 45*b* which employs a cold-heat accumulating member of $Gd_{0.5}Er_{0.5}Rh$ having a large specific heat in the range below 7.5 K.

The three-staged cold-heat accumulation refrigerator having the described construction operates as follows.

It is assumed here that the first-, second- and third-stage displacers 16, 17 and 41 are positioned at the lower stroke ends, with the suction valve 26 and the discharge valve 27 opened and closed, respectively. In this state, the first-, second- and third-stage expansion chambers 22, 23 and 46 are charged with high-pressure helium gas 24 which has been compressed by a helium compressor 25 as the helium gas compression means, whereby high pressure is maintained in each of the first-, second- and third-stage expansion chambers 22, 23 and 46.

Then, the first-, second- and third-stage displacers 16, 17 and 41 are moved upward, so that the helium gas of the high pressure is introduced into the first-, second- and third-stage expansion chambers 22, 23 and 46 through the first-, second- and third-stage cold heat accumulators 20, 21 and 45. Meanwhile, the suction valve 26 and the discharge valve 27 are not moved. The helium gas 24 of the high pressure is cooled down to a predetermined temperature by the cold-heat accumulation material as it passes through the first-, second- and third-stage displacers 16, 17 and 41.

When the first-, second- and third-stage displacers 16, 17 and 41 are moved to the upper stroke ends, the suction valve 26 is closed and the discharge valve 27 is opened, so that the pressurized helium gas 24 is expanded into the low-pressure section, thus causing refrigeration. Consequently, the helium gas 24 is changed into low-temperature, low-pressure gas.

As a result of subsequent downward movement of the first-, second- and third-stage displacers 16, 17 and 41, helium gas 24 of reduced pressure and temperature is discharged through the discharge valve 27 past the first-, second- and third-stage cold-heat accumulators 20, 21 and 24. Consequently, the helium gas of low temperature and pressure is returned to the helium compressor 25 while cooling the cold-heat accumulating material in the first-, second- and third-stage cold heat accumulators 20, 21 and 45.

Then, when the volumes of the first-, second- and third-stage expansion chambers 22, 23 and 46 have minimized, the discharge valve 27 is closed while the suction valve 26 is opened, so that the helium gas 24 of high pressure compressed by the helium compressor is introduced into the first-, second- and third-stage expansion chambers 22, 23 and 46 so as to elevate the pressure in these chambers.

The helium gas of a high pressure, e.g., 20 Bar. is cooled by the first-stage cooler 20 to a temperature of 60 K. and then by the second cooler 21 down to 15 K. The gas is further cooled by the third cooler 45 and then introduced into the third expansion chamber 46.

For instance, assuming that the cold-heat accumulation material of the third cold-heat accumulator 45 is lead, the helium gas 24 is introduced into the third expansion chamber 46 without being sufficiently cooled, because the lead has a specific heat smaller than the helium gas 24. Since this gas is introduced into the third-stage expansion chamber 46, temperature rises in the expansion chamber to cause a loss, whereby the final temperature is on the order of 6.5 K. Furthermore, when GdRh is used as the cold-heat accumulator, the loss is reduced because the specific heat of this material is greater than that of lead, whereby a final temperature as low as 5.5 K. is obtained.

The final temperature can be further reduced to 4.2 K. when GdRh and $Gd_{0.5}Er_{0.5}Rh$ are used as the cold-heat accumulation material (weight ratio of GdRh being 45 to 65%). A low final temperature of 3.68 K. was obtained when the inner surface of ht cylinder 40 was finished to 0.5 mRMS to reduce the leak at the seal.

A similar final temperature was obtained when $Er_3Ni$ was used in place of GdRh.

The high and low pressure of the helium gas were set to 20 Bar and 6 Bar, respectively.

Thus, in the described embodiment, the three-staged cold-heat accumulation refrigerator 30 is constituted by a first-stage cold-heat accumulator 20 which employs a copper-gold network as the cold-heat accumulation material, second-stage cold-heat accumulator 21 which employs lead balls as the cold-heat accumulation material, and the third-stage cold-heat accumulator 45 which has high-temperature section 45*a* employing GdRh as the cold-heat accumulation material and a low-temperature section 45*b* which employs $Gd_{0.5}Fr_{0.5}Rh$ as the heat accumulation material. Consequently, superior refrigerating performance can be obtained: the final temperature of 50 to 80 K. in the first heat stage 10, 10 to 20 K. in the second heat stage 11 and the final temperature of 2 to 4.5 K. in the third heat stage 43, whereby the superconducting magnet can operate stably.

Figure 3:
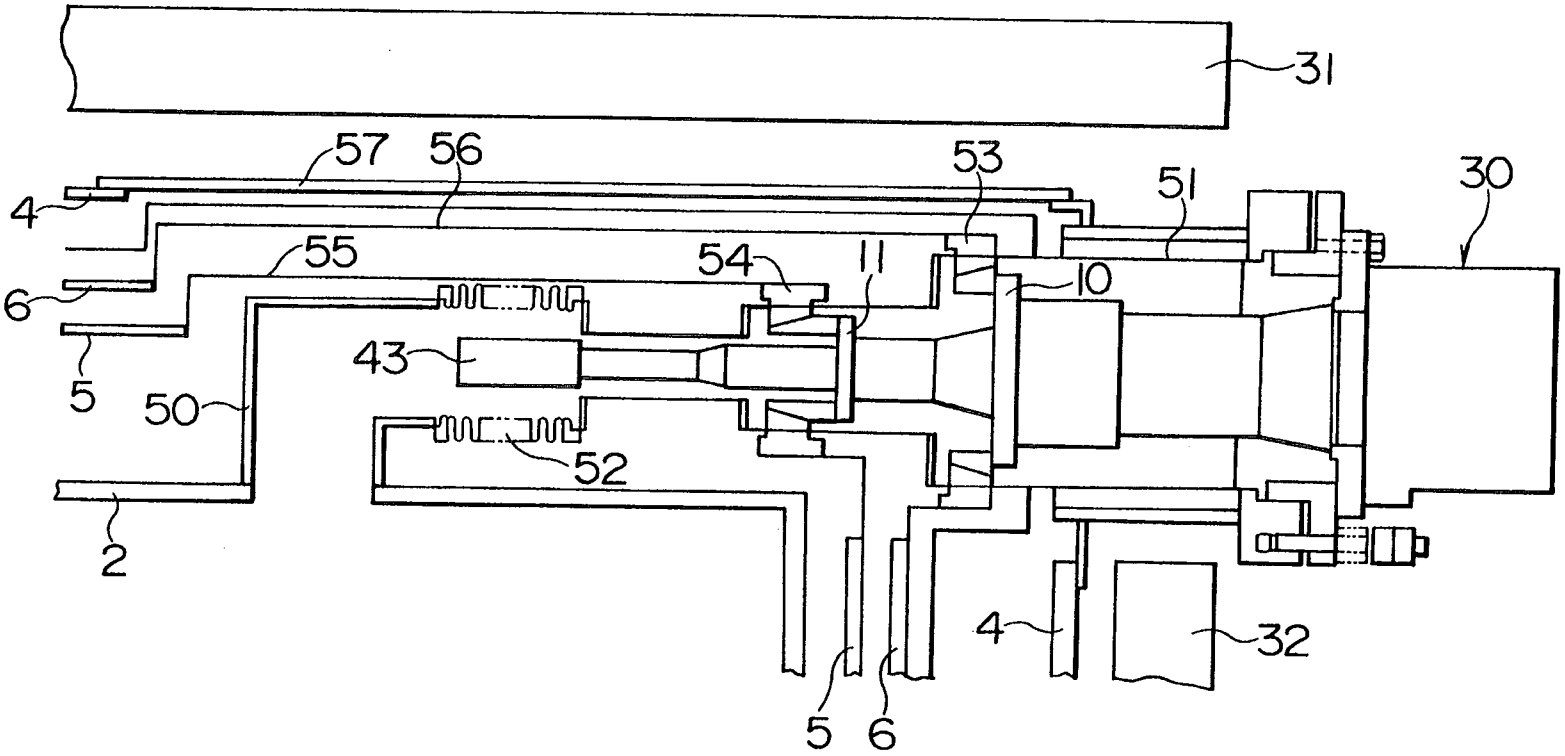
FIG. 3 is a schematic cross-sectional view of a mounting structure of a three-stage cold heat accumulation refrigerator in a superconducting magnet showing a first embodiment of the present invention.

FIG. 3 illustrates the mounting structure for the three-staged cold-heat accumulation refrigerator 30. An L-shaped pipe 50 made of a stainless steel is provided such that one end of the pipe is exposed to the atmosphere of helium gas evaporated in the helium vessel 2, thus providing a lead from the top of the helium vessel 2. The three-staged refrigerator mounting cylinder 51 made of a stainless steel is connected to one end surface of the vacuum vessel 4 so as to extend substantially in parallel with the superconducting coil 1. The L-shaped pipe 50 and the refrigerator mounting cylinder 51 are connected to each other through bellows 52. The refrigerator mounting cylinder 51 has a first stage 53 and a second stage 54 which are of copper. The first and second stages 53 and 54 are thermally coupled to the first thermal shield 6 and the second thermal shield 5.

The three-staged cold-heat accumulation refrigerator 30 is received in the refrigerator mounting cylinder 51 such that the third heat stage thereof is exposed to the helium gas atmosphere which is inducted into the L-shaped pipe 50. In addition, the first heat stage 10 and the second heat stage 11 are secured such that they are thermally coupled to the refrigerator mounting cylinder 51.

Thus, the refrigerator mounting cylinder 51 is secured to the end surface of the vacuum vessel 4 so as to extend substantially in parallel with the axis of the superconducting coil 1. It is therefore possible to obtain sufficient large strokes for the displacers which would contribute to the refrigeration performance of the three-staged cold-heat accumulation refrigerator 30, without increasing the spacing between the components such as the helium vessel 2, second heat shield 5, first heat shield 6 and the vacuum vessel 4, thus realizing a reduction in the size of the superconducting magnet. In addition, since the three-staged cold-heat accumulation refrigerator 30 is detachably attached to the refrigerator mounting cylinder 51, the three-staged cold-heat accumulation refrigerator 30 can be demounted without requiring disassembly of the whole apparatus, thus facilitating maintenance work.

Figure 4:
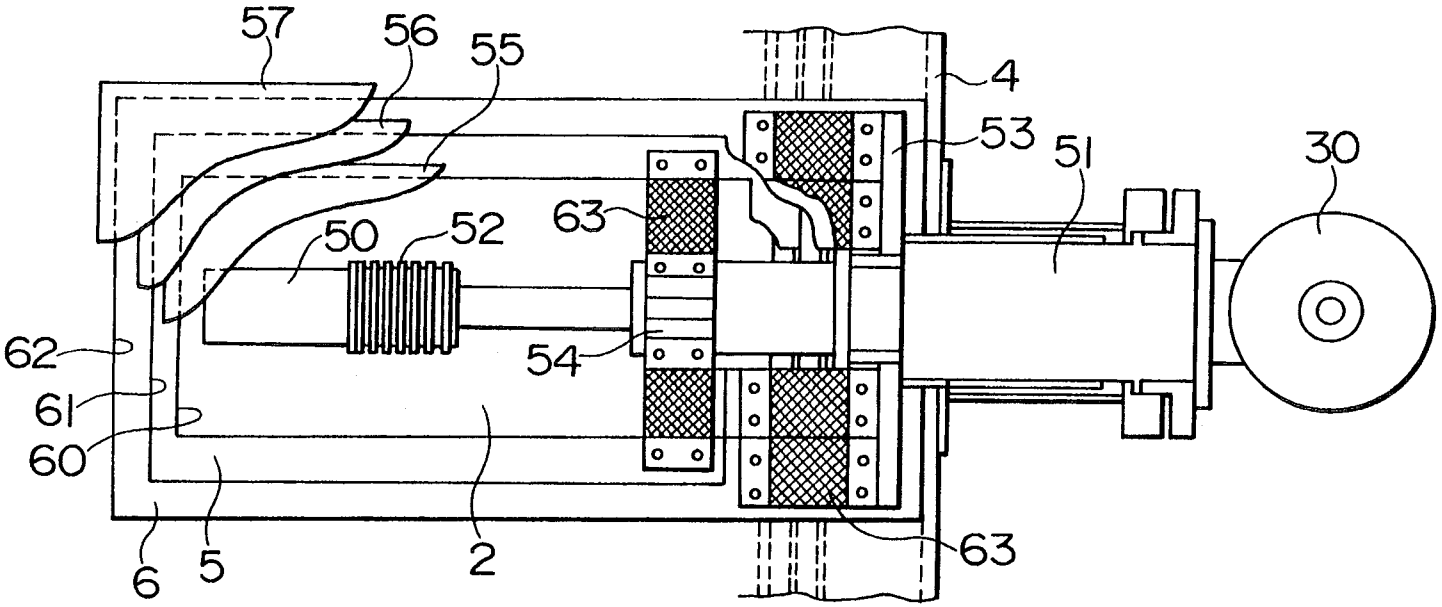
FIG. 4 is a partially cut-out plan view showing a thermal coupling structure between a refrigerator-mounting cylinder and a heat-shield in a superconducting magnet showing a first embodiment of the present invention.

FIG. 4 shows the thermal coupling structure between the refrigerator mounting cylinder 51 and the first and second heat shields 6 and 5. The second heat shield 5 has a second notch 60. The first heat shield 6 is provided with a first notch 61 which is so determined as to expose the second notch 60. The vacuum vessel 4 is provided with a notch 62 so as to expose the first notch 61.

The first stage 53 and the first heat shield 6 are connected to each other through a flexible conductor 63 formed by braiding copper wires. Similar connection is provided also between the second stage 54 and the second heat shield 5. Thermal coupling is thus attained between the first stage 53 and the first heat shield 6 and between the second stage 54 and the second heat shield 5. A second radiation cover 55 and a first radiation cover 56, both being made of copper, are disposed so as to cover the second notch 60 and the first notch 61, respectively. A closure pate 57 made of stainless steel is attached to the vacuum vessel 4 so as to cover the notch 62.

Thus, the three-staged refrigerator mounting cylinder 51 is connected at its one end to an end surface of the vacuum vessel 4 and at its other end to the L-shaped pipe 50 through bellows 52, and the first stage 53 and the second stage 54 of this cylinder 51 are exposed through the notch 62 and the first notch 61. It is therefore possible to easily connect the refrigerator mounting cylinder 51 and the first and second heat shields 6, 5 without being interfered by the vacuum vessel 4. Furthermore, since the first and second notches 61, 60 are covered by the first and second heat radiation covers 56, 55, it is possible to reduce transfer of heat from the exterior.

Figure 5:
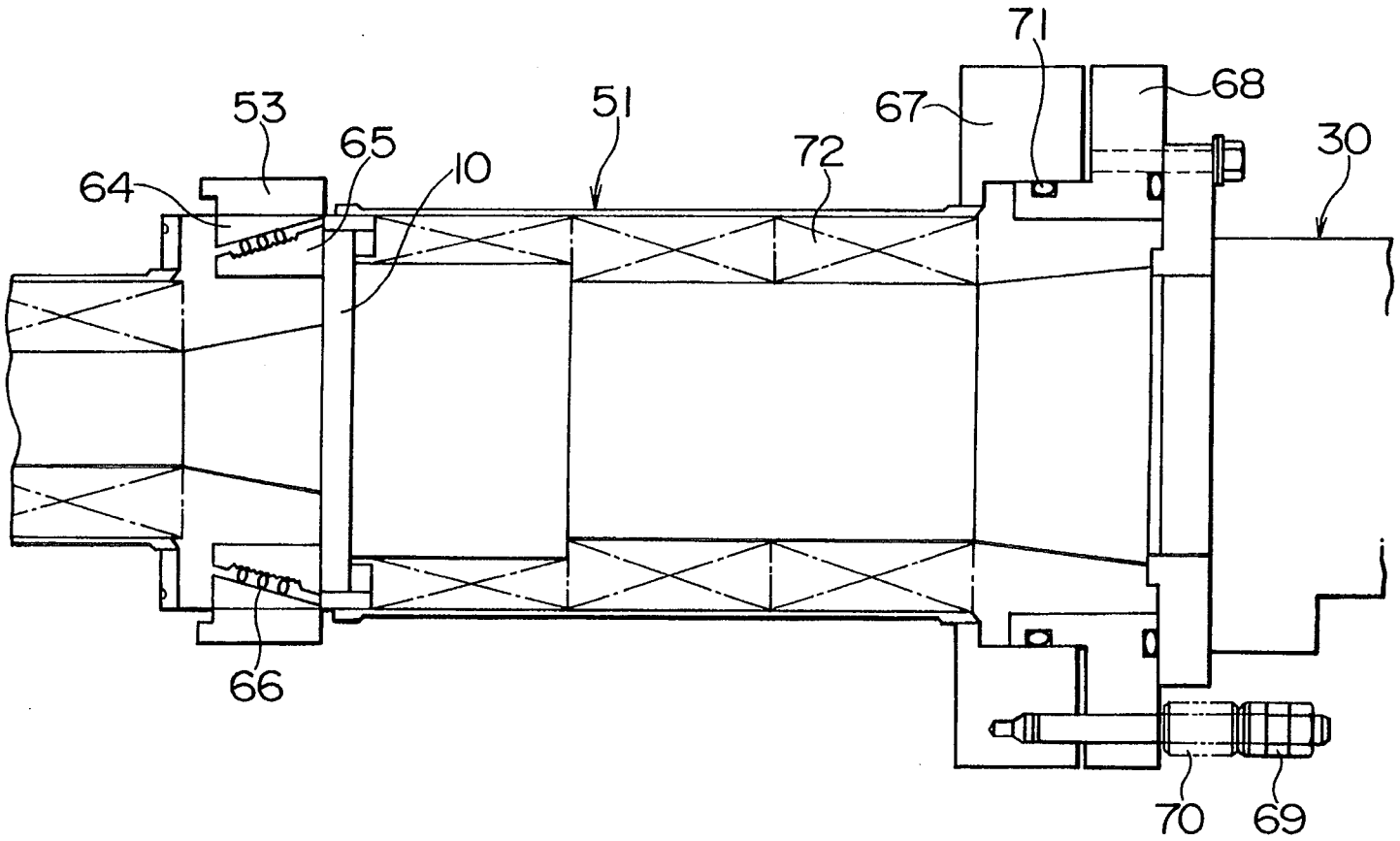
FIG. 5 is a cross-sectional view of essential parts of the coupling structure between the three-stage cold heat accumulation refrigerator and the refrigerator-mounting cylinder in a superconducting magnet showing a first embodiment of the present invention.

FIG. 5 shows the construction for connection between the three-staged cold-heat accumulation refrigerator 30 and the refrigerator mounting cylinder 51. A cylinder-side thermal conductor 64 having a tapered surface is disposed in the inner surface of the refrigerator mounting cylinder 51 at a portion of the latter where the first stage 53 is to be attached. On the other hand, a refrigerator-side thermal conductor 65, having a knurled surface, is provided on the first heat stage 10 of the three-staged heat accumulation refrigerator 30, so as to oppose the above-mentioned tapered surface of the cylinder-side thermal conductor 64.

Although not shown, similar cylinder-side thermal conductor 64 and refrigerator-side thermal conductor 65 are provided also on the portion of the inner wall surface of the refrigerator mounting cylinder 51 where the second stage 54 is to be secured and the second heat stage of the three-staged cold heat accumulation refrigerator 30. The cylinder-side thermal conductor 64 and the refrigerator-side thermal conductor 65 are made of copper which has good thermal conductivity.

An indium wire 66 as the soft metal for thermal coupling is connected between the cylinder-side thermal conductor 64 and the refrigerator-side conductor 65. The refrigerator-side cylinder 51 has a mounting flange 67 to which are secured bolts 69 for fixing a flange 68 of the three-staged cold-heat accumulation refrigerator 30, through the intermediary of elastic disk springs 70. An "O" ring 71 as an airtight sealing member is disposed between the mounting flange 67 and the flange 68. Furthermore, a heat insulating filler 72 fixed to the three-staged cold-heat accumulation refrigerator 30, e.g., foam of natural rubber, is charged between the refrigerator mounting cylinder 51 and the three-staged cold-heat accumulation refrigerator 30.

When the flange 68 is fastened to the mounting flange 67 by means of the bolts 69, the flange 68 slides while airtight seal is maintained by the "O" ring 71, and the indium wire 66 is plastically deformed by the force applied by the bolts 69, thus providing a thermal coupling between the cylinder-side conductor 64 and the refrigerator-side thermal conductor 65.

Displacement of the members due to excessive tightening of the bolts 69, thermal expansion or contraction of the members or vibration is absorbed by the disk springs 70, thus preventing breakdown of the members and inferior thermal coupling. Furthermore, even when the three-staged cold-heat accumulation refrigerator 30 is sufficiently cooled and contracted after mounting on the refrigerator mounting cylinder 51, the desired level of fastening force can be maintained by additional tightening of the bolts 69.

The tapered surface of the refrigerator-side thermal conductor 65 is knurled so as to increase the tightness of contact between the indium wire 66 and the thermal conductor 65. In addition, the plastically deformed indium wire attached to the tapered surface of the refrigerator-side thermal conductor 65 so as to be removed together with the three-staged cold-heat accumulation refrigerator 30 when the latter is demounted.

In the maintenance work, the heat insulating filler 72 is taken out together with the three-staged cold-heat accumulation refrigerator 30, without being left in the refrigerator mounting cylinder 51.

Figure 6:
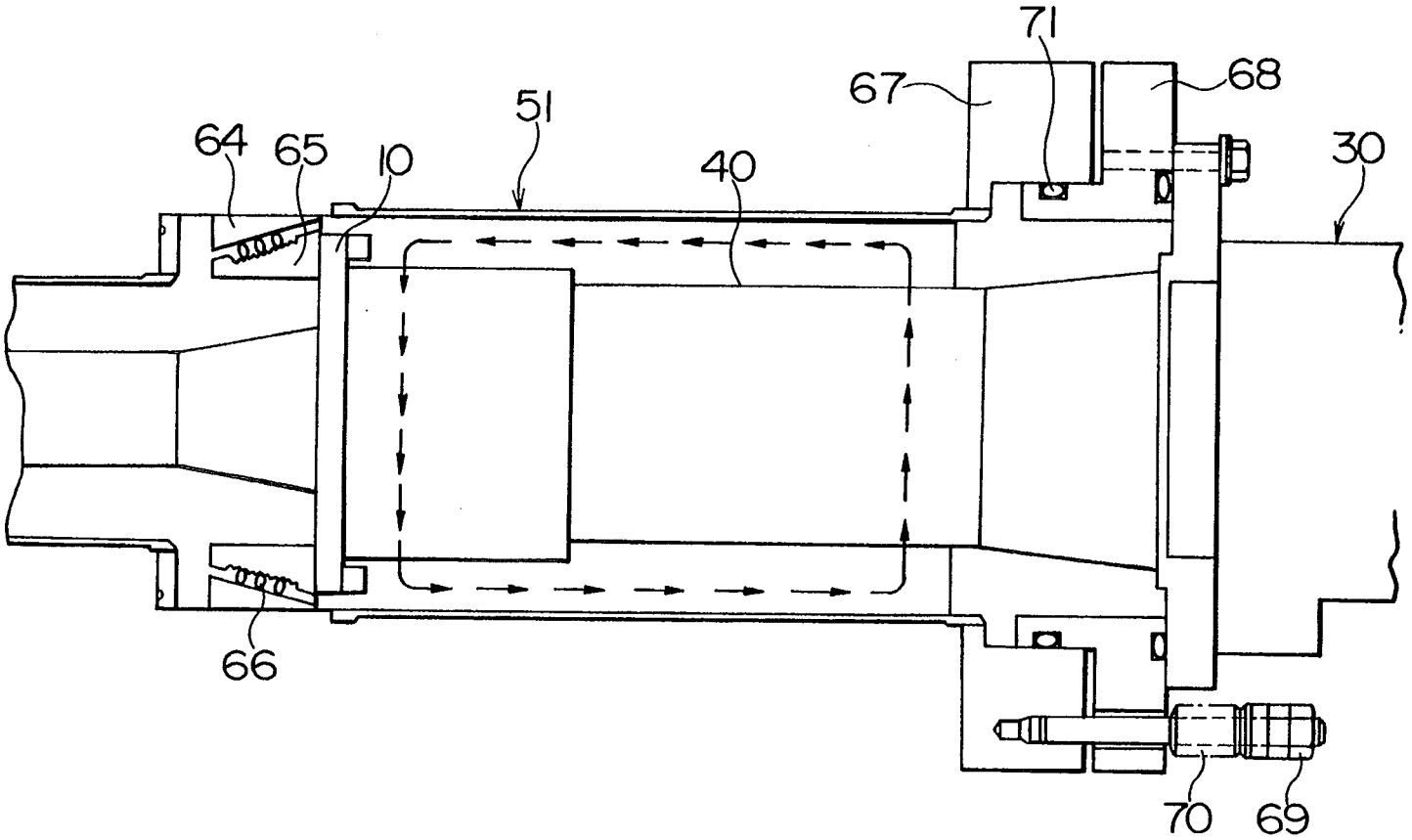
FIG. 6 is a cross-sectional view for the explanation of the heat convection between the three-stage cold heat accumulation refrigerator and the refrigerator-mounting cylinder in the superconducting magnet showing the first embodiment of the present invention.

The space between the refrigerator mounting cylinder 51 and the three-staged cold-heat accumulation refrigerator 30 is charged with the gas of helium which has been evaporated in the helium vessel 2 and introduced through the L-shaped pipe 50. Furthermore, heat gradient is established in each stage of the three-staged cold-heat accumulation refrigerator 30. The helium gas is heated by the high-temperature section of the cylinder 40 and is cooled by the low-temperature section of the same, whereby a convection is caused as indicated by arrows in FIG. 6. This thermal convection is one of the causes of the temperature rise at the first heat stage 10 as the low-temperature section, thus impairing the refrigerating performance of the refrigerator. In this arrangement, the heat insulating filler 72 charged between the refrigerator mounting cylinder 51 and the three-staged cold-heat accumulation refrigerator 30 serves to prevent the convection of the helium gas.

Figure 7A:
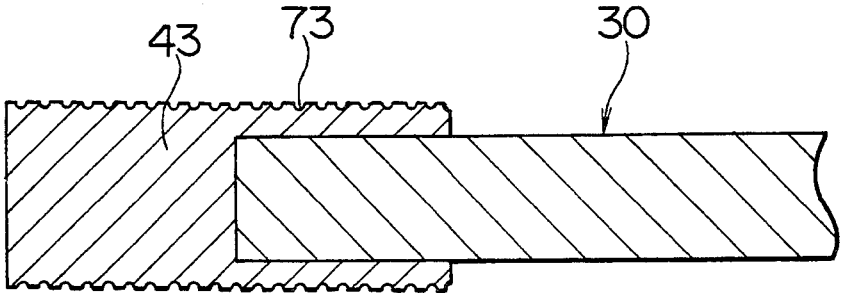
FIGS. 7(*a*) and 7(*b*) are a cross-sectional view and an expanded cross-sectional view respectively of the third heat stage of the three-stage cold heat accumulation refrigerator in the superconducting magnet showing the first embodiment of the present invention.
Figure 7B:
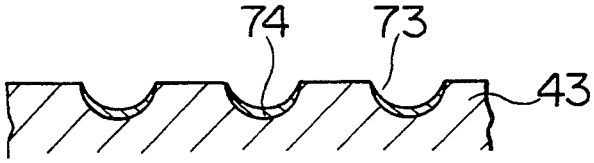

FIGS. 7(*a*) and 7(*b*) respectively show the construction of the third heat stage 43 of the three-staged cold-heat accumulation refrigerator 30. Grooves 73 which provide enlarged heat transfer surface are formed in the outer peripheral surface of the third heat stage so as to extend in parallel with the direction of droplets of the helium which has been again liquefied into liquid phase. The helium gas, which has been evaporated in the helium vessel 2 and extracted through the L-shaped pipe 50, is cooled and condensed by the third heat stage 43 so as to attach to the outer peripheral surface of the third heat stage 43. This helium liquid flows into the grooves 73 and flows down along these grooves 73 into the helium vessel 2 through the L-shaped pipe 50.

The flow of the helium liquid 74 takes place smoothly because the direction of droplets of the return extend in parallel with the grooves 73. Furthermore, since the helium liquid 74 flows into the grooves 73 of the third heat stage 43, the film of liquid helium 74, which attaches to the outer peripheral surface of the third heat stage 43 to impair the heat transfer, is thinned at the crests of the third heat stage 43, thus realizing efficient recondensation of the helium gas into liquid phase.

The enlarged heat-transfer surface formed on the outer periphery of the third heat stage 43 may be provided by fins or by knurling. Introduction of the condensed helium liquid 74 into the helium vessel 2 would be achieved more efficiently when the L-shaped pipe 50 is inclined or when a trough or the like is provided between the third heat stage 43 and the L-shaped pipe 50.

Figure 8:
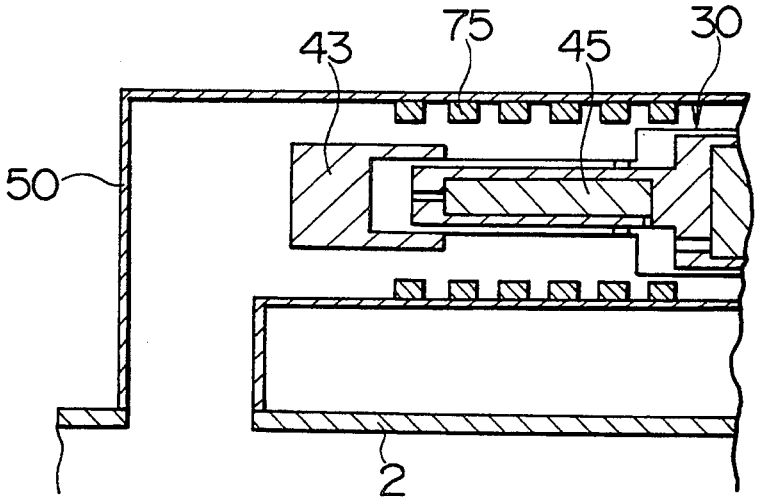
FIG. 8 is a cross-sectional view of the magnetic shield structure of the three-stage cold heat accumulation refrigerator in the superconducting magnet showing the first embodiment of the present invention.

FIG. 8 illustrates the construction of the magnetic shield of the third-stage cold-heat accumulator 45 of the three-staged cold-heat accumulation refrigerator 30. A plurality of short iron rings 75 as the magnetic rings are provided on the inner wall surface of the L-shaped pipe 50 at a predetermined spacing so as to surround the third-stage cold-heat accumulator of the three-staged cold-heat accumulation refrigerator 30.

The magnetic resonance image diagnosis apparatus is required to develop a magnetic field of a high degree of uniformity. In operation of the three-staged cold-heat accumulation refrigerator 30, the external magnetic field tends to be disturbed as a result of the movement of the third-stage displacer 41 which has a third-stage cold-heat accumulator 45 employing, as the cold-heat accumulation material, rare earth materials such as GdRh and $Gd_{0.5}Er_{0.5}Rh$. Such tendency, however, is suppressed by the above-described magnetic seal. The spacing between the adjacent iron rings 5 of the magnetic shield provides an effect to prevent conduction of heat through the magnetic shield.

The first embodiment having the described construction offers the following advantages.

The third heat stage 43 is attached to the vacuum vessel 4 so as to extend substantially in parallel with the direction of the axis of the superconducting coil 1, such that the third heat stage 43 is exposed to the atmosphere of helium gas which is formed as a result of evaporation in the helium vessel 2. Therefore, helium gas can be efficiently liquefied again to ensure stable operation of the superconducting magnet, and large strokes are preserved from the first-, second- and third-stage displacers 16, 17 and 41 which contribute to the refrigeration performance of the refrigerator, thus ensuring sufficiently high refrigeration performance. At the same time, the height of the superconducting magnet is reduced to enable miniaturization of the refrigerator, thus allowing the height of the ceiling of the installation site to the lowered, while facilitating transportation.

Furthermore, since the three-staged cold-heat accumulation refrigerator 30 is detachably mounted in the refrigerator mounting cylinder 51, the three-staged cold-heat accumulation refrigerator 30 can be demounted without requiring disassembly of the whole apparatus, whereby the work for maintenance is facilitated.

In addition, the construction for mounting the three-staged cold-heat accumulation refrigerator 30 can be simplified because the three-staged cold-heat refrigerator 30 is secured to the vacuum vessel 4 substantially in parallel with the axis of the superconducting coil 1, in such a manner that the third heat stage 43 is exposed to the interior of the L-shaped pipe 50 which is secured to the helium vessel 2 such that one end of the pipe 50 is exposed to the helium gaseous phase of the helium evaporated in the helium vessel 2.

Furthermore, since the three-staged cold-heat accumulation refrigerator 30 is attached to the end surface of the vacuum vessel 4 so as to extend substantially in parallel with the axis of the superconducting coil 1, the height of the superconducting magnet can be further reduced to realize the miniaturization of the whole apparatus.

The second heat shield 5 is provided with the second notch 60 and the first heat shield 6 is provided with a first notch 61 such that the second notch 60 is exposed through the first notch 61. The first heat shield 6 is thermally coupled at the first notch 61 to the refrigerator mounting cylinder through the flexible thermal conductor 63, and the second heat shield 5 also is thermally coupled at the second notch 60 to the refrigerator mounting cylinder through the flexible conductor 63, whereby the assembly can be done at high efficiency without impairing thermal coupling due to interference with the first and second seals 5, 6.

Furthermore, introduction of heat from the external side can be reduced since the first and second notches 61, 60 formed in the first and second heat shields 6, 5 are covered by the first and second radiation covers 56, 55.

It is also to be understood that, since the gap between the three-staged cold-heat accumulation refrigerator 30 and the refrigerator mounting cylinder 51 is filled with the heat insulating filler 72, it is possible to prevent convection of helium gas introduced into the above-mentioned space, thus contributing to improvement in the refrigeration performance of the three-staged cold-heat accumulation refrigerator 30.

Furthermore, the heat insulating filler 72, which is placed between the three-staged cold-heat accumulation refrigerator 30 and the refrigerator mounting cylinder 51 and which is fixed to the three-staged cold-heat accumulation refrigerator 30, can be taken out together with the three-staged cold-heat accumulation refrigerator 30 when the latter is demounted, thus facilitating maintenance.

Each heat stage of the three-staged cold-heat accumulation refrigerator 30 is provided with a refrigerator-side thermal conductor 65 having a tapered surface, and the portion of the inner surface of the refrigerator mounting cylinder 51 facing the refrigerator-side thermal conductor 65 is provided with a cylinder-side thermal conductor 64, with an indium wire 66 interposed between these thermal conductors 64 and 65. Therefore, a thermal coupling is securely formed between the refrigerator mounting cylinder 51 and the three-staged cold-heat accumulation refrigerator 30, through an indium wire 66 which is plastically deformed between these thermal conductors 65 and 64.

Furthermore, since the tapered surface of the refrigerator-side thermal conductor 65 has been knurled, the indium wire 66, which has been plastically deformed between the refrigerator-side thermal conductor 65 and the cylinder-side thermal conductor 64 to provide the thermal coping threbetween, attaches to the tapered surface of the refrigerator thermal conductor 65 and is taken out together with the refrigerator when the latter is demounted, without being left on the cylinder-side thermal conductor 64, thus improving efficiency in the maintenance work.

Furthermore, the flange 68 is fastened to the mounting flange 67 by means of bolts 69 through the disk springs 70, with the "O" ring placed between the inner peripheral surface of the mounting flange 67 and the outer peripheral surface of the flange 68, any displacement of these flanges due to thermal expansion or contraction or vibration can be well absorbed by the disk springs 67. The required level of fastening force can be attained by additional tightening of the bolts 69 conducted after sufficient cooling of the three-staged cold-heat accumulation refrigerator 30 mounted in the mounting cylinder.

Furthermore, grooves 73 formed in the outer peripheral surface of the third heat stage 43 hastens the dropping of re-condensed helium liquid 74, thus avoiding attaching of thick film of the liquid helium 74 on the entire outer peripheral surface of the third heat stage 43. This effect is enhanced when the grooves 73 are formed to extend in parallel with the direction of dripping of the liquefied helium 74.

Furthermore, since a plurality of short iron rings 75 are disposed on the inner peripheral surface of the L-shaped pipe 50 at a predetermined spacing so as to surround the third-stage cold-heat accumulator 45, it is possible to prevent disturbance of the external magnetic field attributable to the reciprocatory motion of the third-stage cold-heat accumulator 45, while the spacing between adjacent iron rings 75 provides a barrier for heat conduction, thus ensuring stable operation of the superconducting magnet.

Finally, the three-staged cold-heat accumulation refrigerator 30 of the present invention, which has the first-stage cold heat accumulator 20 employing a copper-gold network as the cold-heat accumulation material, the second-stage cold-heat accumulator 21 employing lead balls as the cold-heat accumulation material, and the third-stage cold-heat accumulator having the high-temperature section 45*a* using GdRh as the cold-heat accumulation material and the low-temperature section employing $Gd_{0.5}Er_{0.5}Rh$ as the cold-heat accumulation material. With this arrangement, it is possible to attain superior refrigeration performance: namely, the final temperature of 50 to 80 K. in the first heat stage 10, the final temperature of 10 to 20 K. in the second heat stage 11 and the final temperature of 2 to 4.5 K. in the third heat stage 43. Consequently, the helium gas evaporated in the third heat stage 43 can be liquefied again in the third heat stage 43, thus ensuring stable operation of the superconducting magnet.

Second Embodiment

The second embodiment is an embodiment of a superconducting magnet in accordance with aspect 11 of the present invention.

Figure 9:
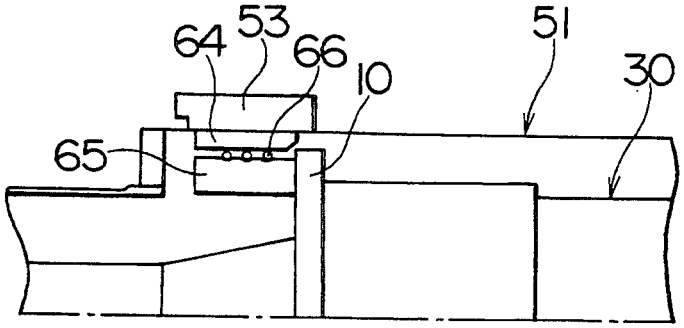
FIG. 9 is an essential cross-sectional view of the superconducting magnet showing the second embodiment of the present invention.

In the first embodiment, a cylinder-side thermal conductor 64 having a tapered surface, mounted in the refrigerator, is thermally connected to the refrigerator-side thermal conductor 65 having a tapered knurled surface with the indium wire 66 grasped between them. In the second embodiment, however, as shown in FIG. 9, the cylinder-side thermal conductor 64 mounted in the refrigerator is formed into a rectangular shape, and the refrigerator-side thermal conductor 65 is formed into a hollow cylindrical shape, which conductor is elastic because the outer peripheral surface thereof is nicked and a plurality of slits are provided in a direction parallel to the shaft of the refrigerator. They are thermally connected to each other with the indium wire 66 grasped between them, making it possible to absorb the displacement of the member caused in a direction perpendicular to the shaft of the refrigerator, which displacement is caused due to thermal contraction or vibrations and making it possible to improve the reliability of thermal connection.

Third Embodiment

The third embodiment is another embodiment of the superconducting magnet in accordance with aspect 11 of the present invention.

Figure 10:
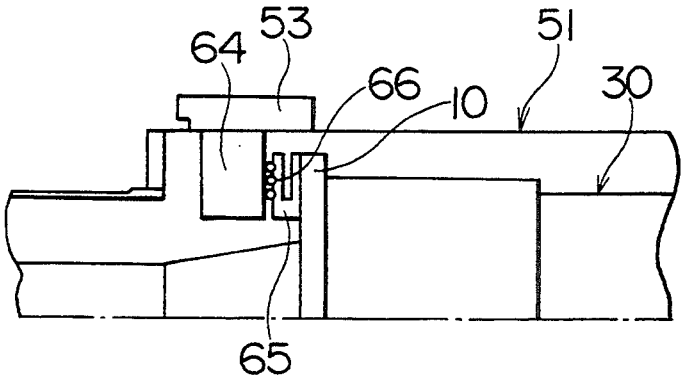
FIG. 10 is an essential cross-sectional view of the superconducting magnet showing the third embodiment of the present invention.

In the second embodiment, the cylinder-side thermal conductor 64 formed into a rectangular shape mounted in the refrigerator is thermally connected to the refrigerator-side thermal conductor 65 formed into a hollow cylindrical shape, which conductor is elastic because the outer peripheral surface thereof is nicked and a plurality of slits are provided in a direction parallel to the shaft of the refrigerator. They are thermally connected to each other with the indium wire 66 grasped between them. In the third embodiment, however, as shown in FIG. 10, the refrigerator-side thermal conductor 65 is formed into the shape of a sideways U in cross section to be elastic, making it possible to absorb the axial displacement of refrigerator caused in the member, which displacement is caused due to thermal contraction or vibrations, and making it possible to improve the reliability of thermal connection.

Fourth Embodiment

The fourth embodiment is yet another embodiment of the superconducting magnet in accordance with aspect 11 of the present invention.

Figure 11:
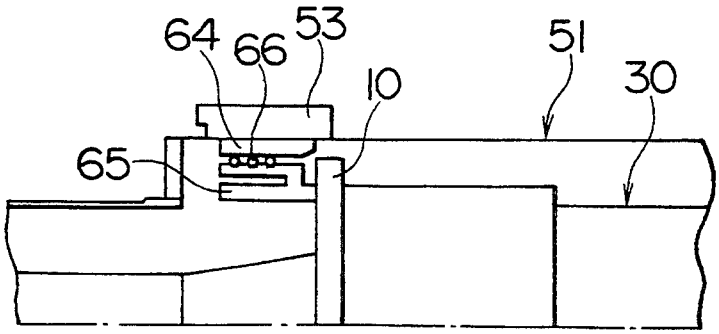
FIG. 11 is an essential cross-sectional view of the superconducting magnet showing the fourth embodiment of the present invention.

In the second embodiment, the cylinder-side thermal conductor 64 in a rectangular shape mounted in the refrigerator is thermally connected to the refrigerator-side thermal conductor 65 which is elastic because the outer peripheral surface thereof is nicked and a plurality of slits are provided in a direction parallel to the shaft of the refrigerator. with the indium wire 66 grasped between them. In the fourth embodiment, as shown in FIG. 11, the refrigerator-side thermal conductor 65 is formed into the shape of a sideways U in cross section to be elastic, realizing the same effect as described above.

Fifth Embodiment

The fifth embodiment is another embodiment of a superconducting magnet in accordance with aspect 15 of the present invention.

In the first embodiment, a plurality of short iron rings 75 are disposed on the inner wall surface of the L-shaped pipe 50 in such a manner as to surround the third-stage cold heat accumulator 45 at a predetermined clearance. In the fifth embodiment, however, a plurality of short iron rings 75 are disposed on the outer wall surface of the L-shaped pipe 50 in such a manner as to surround the third-stage cold heat accumulator 45 at a predetermined clerance, realizing the same effect as described above.

Sixth Embodiment

The sixth embodiment is an embodiment of a superconducting magnet in accordance with aspect 16 of the present invention.

Figure 12:
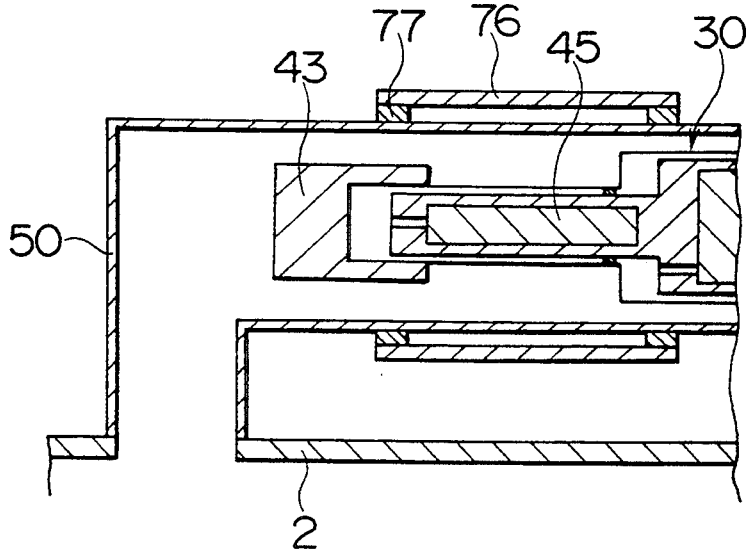
FIG. 12 is an essential cross-sectional view of the superconducting magnet showing the sixth embodiment of the present invention.

In the first embodiment, a plurality of short iron rings 75 are disposed on the inner wall surface of the L-shaped pipe 50 in such a manner as to surround the third-stage cold heat accumulator 45 at a predetermined clearance. In the sixth embodiment, however, as shown in FIG. 12, a magnetic substance, for example, a hollow cylindrical magnetic shield 76 made of iron, is adiabatically supported on the outer peripheral wall surface of the L-shaped pipe 50 in such a manner as to surround the third-stage cold heat accumulator 45 with a heat-insulating member 77 provided between them.

According to the sixth embodiment, since the magnetic shield 76 is disposed in such a manner as to surround the third-stage cold heat accumulator 45 in which a rare earth material is stored, the outside magnetic field can be prevented from being disturbed as the third-stage cold heat accumulator 45 reciprocates. Also, since the magnetic shield 76 is adiabatically supported on the L-shaped pipe 50 by the heat-insulating member 77, thermal conduction through the magnetic shield 76 is prevented, making it possible to stably operate the superconducting magnet.

Seventh Embodiment

The seventh embodiment is another embodiment of the superconducting magnet in accordance with aspect 16 of the present invention.

In the sixth embodiment, the magnetic shield 76 is adiabatically supported on the outer peripheral surface of the L-shaped pipe 50 in such a manner as to surround the third-stage cold heat accumulator 45 with the heat-insulating member 77 provided between them. In the seventh embodiment, however, the magnetic shield 76 is supported at one end thereof on the outer peripheral surface of the L-shaped pipe 50 in such a manner as to surround at least the third-stage cold heat accumulator 45, realizing the same effect as described above.

Eighth Embodiment

The eighth embodiment is an embodiment of a superconducting magnet in accordance with aspect 17 of the present invention.

In the sixth embodiment, the hollow cylindrical magnetic shield 76 made of iron is adiabatically supported on the outer peripheral surface of the L-shaped pipe 50 in such a manner as to surround the third-stage cold heat accumulator 45 with the heat-insulating member 77 provided between them. In the eighth embodiment, however, a magnetic foaming substance formed of natural rubber to which iron particles which are magnetic substances are mixed as an heat insulating filler is made to fill the space between the third-stage accumulation refrigerator 30 and the cylinder 51 mounted on the refrigerator, realizing the same effect as described above.

Ninth Embodiment

The ninth embodiment is another embodiment of the superconducting magnet in accordance with aspect 17 of the present invention.

In the eighth embodiment, a magnetic foaming substance formed of natural rubber to which iron particles which are magnetic substances are mixed as an heat insulating filler is made to fill the space between the third-stage accumulation refrigerator 30 and the cylinder 51 mounted on the refrigerator in such a manner as to surround the third-stage cold heat accumulator 45. In the ninth embodiment, however, the magnetic foaming substance is made to fill the entire space between the third-stage accumulation refrigerator 30 and the cylinder 51 mounted on the refrigerator. In addition to the effect of the eighth embodiment, the thermal convection of a helium gas between the third-stage accumulation refrigerator 30 and the cylinder 51 can also be prevented.

Tenth Embodiment

The tenth embodiment is an embodiment of a method of mounting a superconducting magnet in accordance with aspect 18 of the present invention.

Mounting the third-stage accumulation refrigerator 30 onto the cylinder 51 mounted on the refrigerator will be explained below with reference to FIG. 5.

Initially, an O ring 71 is mounted on a flange 68 of the third-stage accumulation refrigerator 30, and the indium wire 66 is disposed on the tapered surface of the refrigerator-side thermal conductor 65. Thereafter, the third-stage accumulation refrigerator 30 is inserted into the cylinder 51 mounted on the refrigerator, and the flange 68 of the refrigerator is fastened to a mounting flange 67 by means of a bolt 69 by means of a belleville spring 70.

In the third-stage accumulation refrigerator 30, the flange 68 slides while maintaining airtightness, causing the indium wire 66 between the refrigerator-side thermal conductor 65 and the cylinder-side thermal conductor 64 mounted in the refrigerator to be plastically deformed. At this time, the refrigerator-side thermal conductor 65 is thermally connected to the cylinder-side thermal conductor 64 mounted in the refrigerator through the indium wire 66.

The cylinder 51 mounted on the refrigerator is maintained at a low temperature, whereas the third-stage accumulation refrigerator 30 is cooled from normal temperature to low temperature, and thermal contraction is caused in the third-stage accumulation refrigerator 30 with the passage of time. The thermal contraction in the third-stage accumulation refrigerator 30 is absorbed as a result of the energization force of the belleville spring 70 becoming weak, ensuring the thermal connection between the refrigerator-side thermal conductor 65 and the cylinder-side thermal conductor 64 mounted in the refrigerator.

Next, after the third-stage accumulation refrigerator 30 is sufficiently cooled and thermal contraction stops, an increased fastening is performed by using the bolt 69, restoring the energization force of the belleville spring 70 which has become weak in consequence with the thermal contraction to a set value.

According to the tenth embodiment, since an increased fastening is performed using the bolt 69 and the third-stage accumulation refrigerator 30 is assembled after it is sufficiently cooled, a decrease in the fastening force of the bolt 69 due to the cooling and thermal contraction of the third-stage accumulation refrigerator 30 is prevented, making it possible to mount the third-stage accumulation refrigerator 30 at a predetermined fastening force and to ensure the thermal connection between the refrigerator-side thermal conductor 65 and the cylinder-side thermal conductor 64 mounted in the refrigerator even if a displacement due to thermal variations, vibrations or the like occurs.

Eleventh Embodiment

The eleventh embodiment is an embodiment of a superconducting magnet in accordance with aspect 4 of the present invention.

Figure 13:
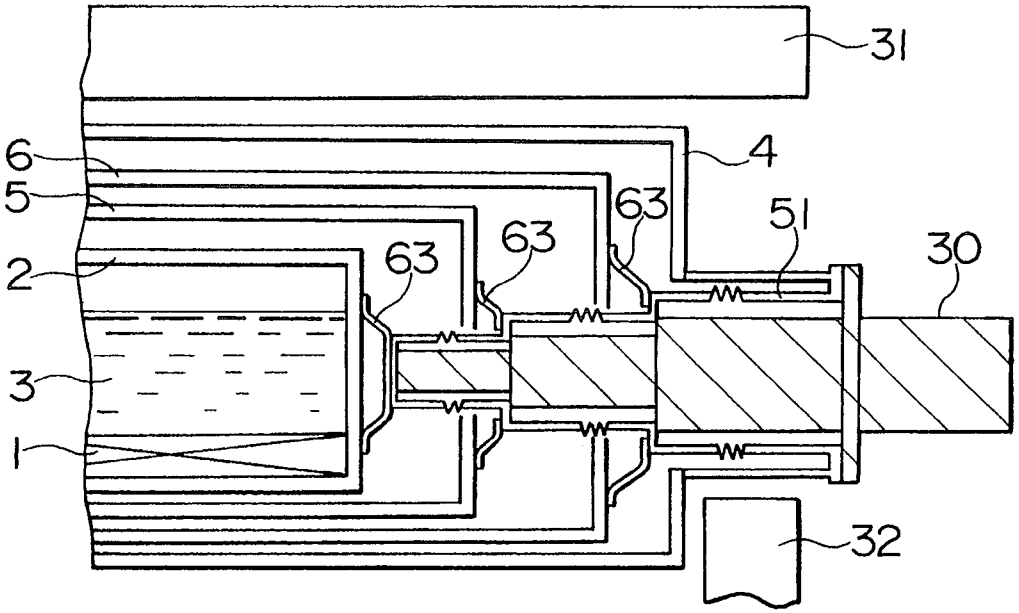
FIG. 13 is an essential cross-sectional view of the superconducting magnet showing the eleventh embodiment of the present invention.

In the first embodiment, the third-stage accumulation refrigerator 30 is mounted substantially parallel to the axis of the superconducting coil 1 so that the third-stage heat stage 43 is exposed in an atmosphere of helium gas which evaporates within the helium vessel 2. In the eleventh embodiment, however, as shown in FIG. 13, the third-stage accumulation refrigerator 30 is mounted in a direction substantially parallel to the axis of the superconducting coil 1 so that the third-stage heat stage 43 cools the helium vessel 2, realizing the same effect as described above.

Twelfth Embodiment

The twelfth embodiment is an embodiment of a superconducting magnet in accordance with aspect 20 of the present invention.

Figure 14:
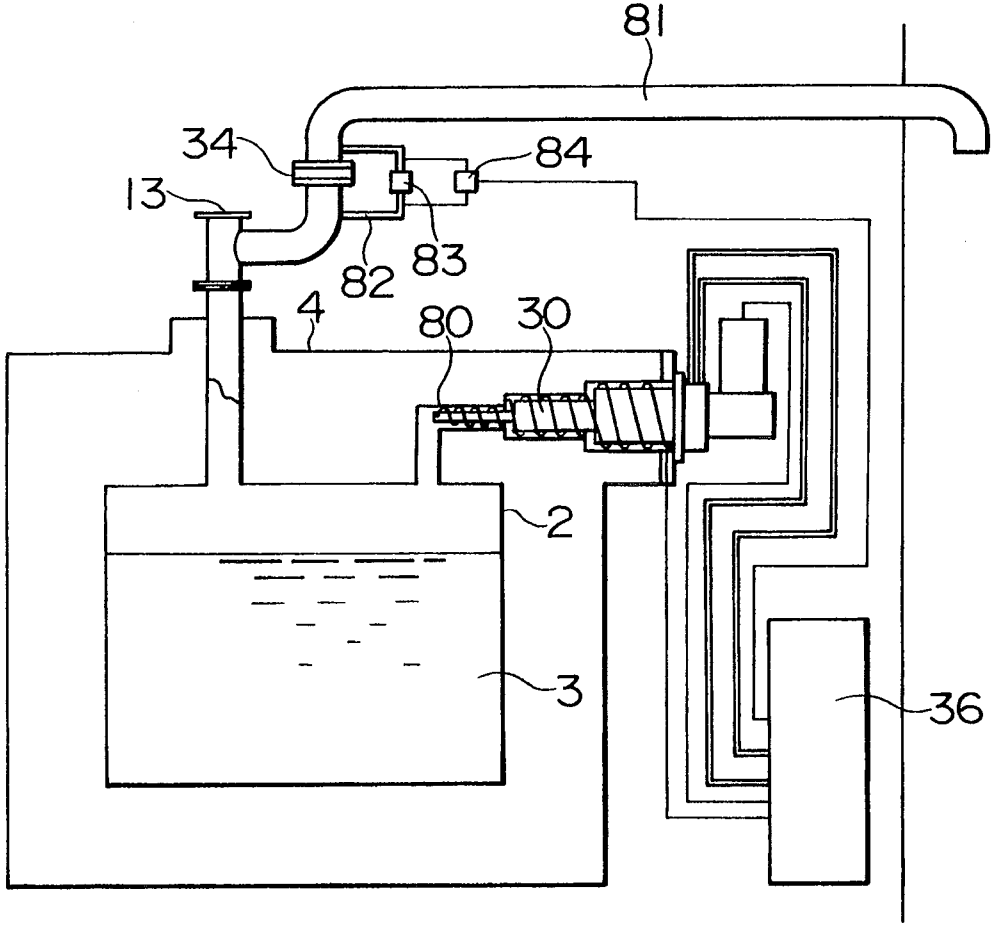
FIG. 14 is a schematic cross-sectional view of the superconducting magnet showing the twelfth embodiment of the present invention.

FIG. 14 is a schematic illustration of the construction of a superconducting magnet in accordance with the twelfth embodiment of the present invention. In FIG. 14, reference numeral 80 denotes a heater mounted on the third heat stage of the third-stage accumulation refrigerator 30; reference numeral 81 denotes a discharge pipe for communicating a port 13 with the outside, on the passage of which pipe a pressure releasing valve 34 is disposed; reference numeral 82 denotes a bypass pipe of the discharge pipe 81; reference numeral 83 denotes a non-return valve disposed on the bypass pipe 82; and reference numeral 84 denotes a differential pressure sensor which serves as a pressure detecting means.

Next, the operation of the twelfth embodiment will be explained.

In a case in which liquid helium within the helium vessel 2 is abruptly evaporated and the pressure within the helium vessel 2 increases abnormally during the operation of the superconducting magnet, the helium gas is discharged to the outside from the pressure releasing valve 34 through the discharge pipe 81, thereby preventing the superconducting magnet from being destroyed.

When the superconducting magnet is normally operated, liquid helium 3 within the helium vessel 2 is evaporated because heat enters from the outside. The pressure within the helium vessel 2 is detected as a pressure difference with the outside atmospheric pressure which is a reference pressure by means of the differential pressure sensor 84 from both ends of the non-return valve 83 of the bypass pipe 82. The detected signals from the differential pressure sensor 84 are input to the pressure controller unit 36.

The pressure controller unit 36 controls pressure as described below on the basis of detected signals from the differential pressure sensor 84.

Initially, when the differential pressure becomes 0 $Kg/cm^2$ or less, an electric current is supplied to the heater 80, increasing the temperature within the helium vessel 2. With an increase in the temperature within the helium vessel 2, the liquid helium 3 is evaporated and the pressure within the helium vessel 2 increases. When the pressure becomes 0 $Kg/cm^2$ or more, the supply of an electric current to the heater 80 is stopped.

If, however, the differential pressure exceeds 0.5 $Kg/cm^2$, the refrigerating cycle of the third-stage accumulation refrigerator 30 is speeded and the refrigerating power is increased, thereby accelerating the reliquefaction of the helium gas by means of the third-stage heat stage 43. The pressure within the helium vessel 2 decreases due to the reliquefaction of the helium gas. If the differential pressure becomes 0.5 $Kg/cm^2$ or less, the third-stage accumulation refrigerator 30 is operated at a predetermined refrigerating cycle.

As described above, according to the twelfth embodiment, the pressure difference between the outside atmospheric pressure and the atmospheric pressure within the helium vessel 2 is detected by the differential pressure sensor 84, and the turning on and off of the heater 80 and the refrigerating cycle speed of the third-stage accumulation refrigerator 30 are controlled so that the pressure difference is in a range from 0 to 0.5 $Kg/cm^2$. Therefore, the pressure within the helium vessel 2 can be controlled in response to the variation in the outside atmospheric pressure, preventing air from being sucked in as a result of the pressure within the helium vessel 2 becoming a negative pressure. Strain of the helium vessel 2 caused by variations in the outside atmospheric pressure or the pressure within the helium vessel 2 can be prevented. No distortion occurs in the superconducting coil 1. Thus, a superconducting magnet having high performance can be obtained.

EMBODIMENT 13

Embodiment 13 is another embodiment of the superconductive magnet according to aspect 20 of the present invention.

Figure 15:
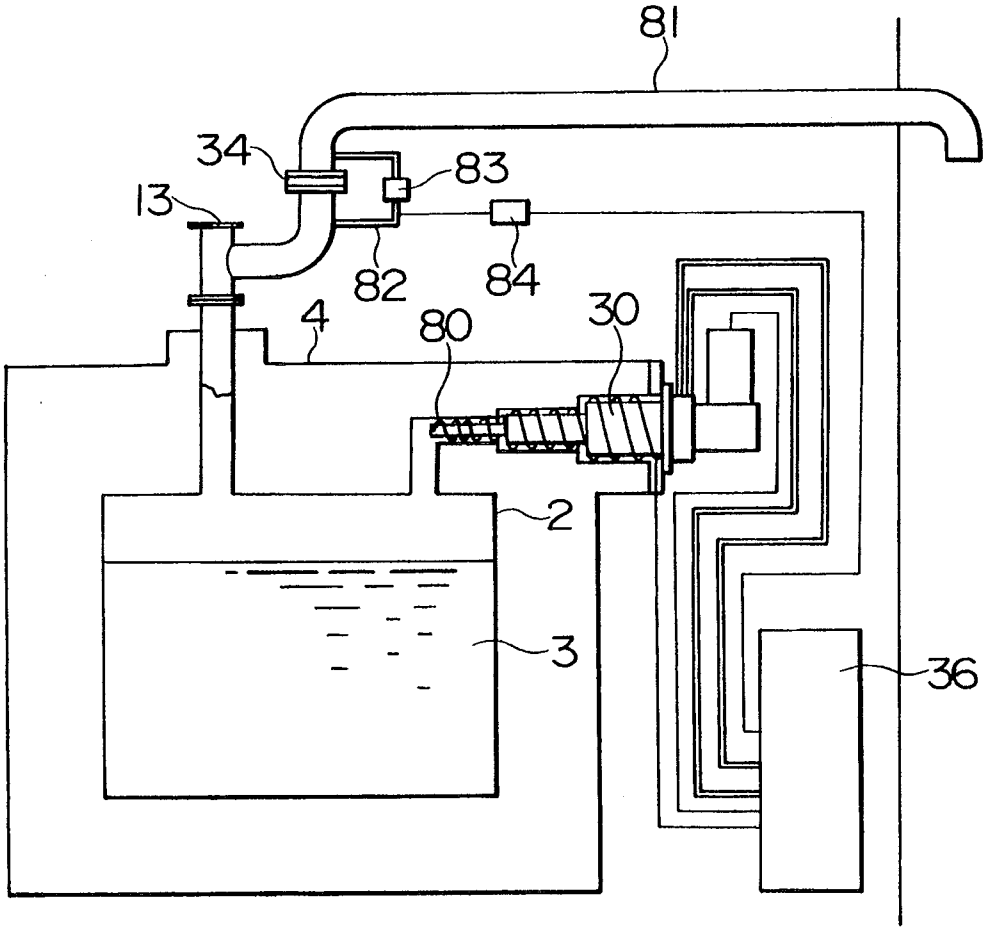
FIG. 15 is a schematic cross-sectional view of the superconducting magnet showing the 13th embodiment of the present invention.

While Embodiment 12 above detects differential pressure between the pressure inside the helium chamber 2 and the pressure in the outdoors by using the differential pressure type pressure sensor 84 and controls the switching on/off of the heater 80 and the freezing cycle rate of the 3-stage cold heat accumulation refrigerator 30 so as to maintain the differential pressure within a predetermined range. Embodiment 13 detects differential pressure between the pressure inside a helium chamber 2 and the air pressure inside the room, which is employed as the reference pressure, by using a differential pressure type pressure sensor 84, as shown in FIG. 15.

If the differential pressure detected by the differential pressure type pressure sensor 84 is lower than 0 $Kg/cm^2$, Embodiment 13 above supplies electricity to a heater 80 and stops the operation of a 3-stage cold heat accumulation refrigerator 30.

By supplying electricity to the heater 80, the temperature inside the helium chamber 2 is increased, which causes liquid helium 3 to evaporate, thus increasing the pressure inside the helium chamber 2. Further, by stopping the operation of the 3-stage cold heat accumulation refrigerator 30, re-liquefaction of the helium gas by means of a third heat stage 43 in the helium chamber 2 is stopped; cooling of first and second heat shield 6, 5 is stopped; heat transmission from the outside to the inside of the helium chamber 2 occurs; the liquid helium 3 evaporates; and thus the pressure inside the helium chamber 2 increases.

If the pressure inside the helium chamber 2 is increased so that the differential pressure becomes 0 $Kg/cm^2$ or higher, Embodiment 13 stops supplying electricity to the heater 80 and restarts the operation of the 3-stage cold heat accumulation refrigerator 30.

If the differential pressure exceeds 0.5 $Kg/cm^2$, Embodiment 13 accelerates the freezing cycle of the 3-stage cold heat accumulation refrigerator 30 so as to increase the freezing capacity thereof, thus accelerating re-liquefaction of the helium gas performed by the third heat stage 43. Due to the re-liquefaction of the helium gas, the pressure inside the helium chamber 2 decreases. When the differential pressure is reduced to 0.5 $Kg/cm^2$ or less, Embodiment 13 causes the 3-stage cold heat accumulation refrigerator 30 to operate at a predetermined freezing cycle.

As described above, because Embodiment 13 detects differential pressure between the pressure inside the helium chamber 2 and the air pressure in the room by using the differential pressure type pressure sensor 84 and controls the switching on/off of the heater 80 and the switching on/off and freezing cycle rate of the 3-stage cold heat accumulation refrigerator 30 so that the differential pressure is maintained within the rage 0–0.5 $Kg/cm^2$, the embodiment is able to control the pressure inside the helium chamber 2 in response to changes in the air pressure inside the room. As a result, the pressure inside the helium chamber 2 will not become negative so as to cause suction of the air into the helium chamber 2; distortion of the helium chamber will not be caused by air pressure fluctuation in the outdoors or pressure fluctuation inside the helium chamber 2; and distortion of the magnetic field created by the super conductive coil 1 will not be caused. Thus, a high-performance superconductive magnet is achieved.

EMBODIMENT 14

Embodiment 14 is an embodiment of the superconductive magnet according to aspect 21 of the present invention.

Figure 16:
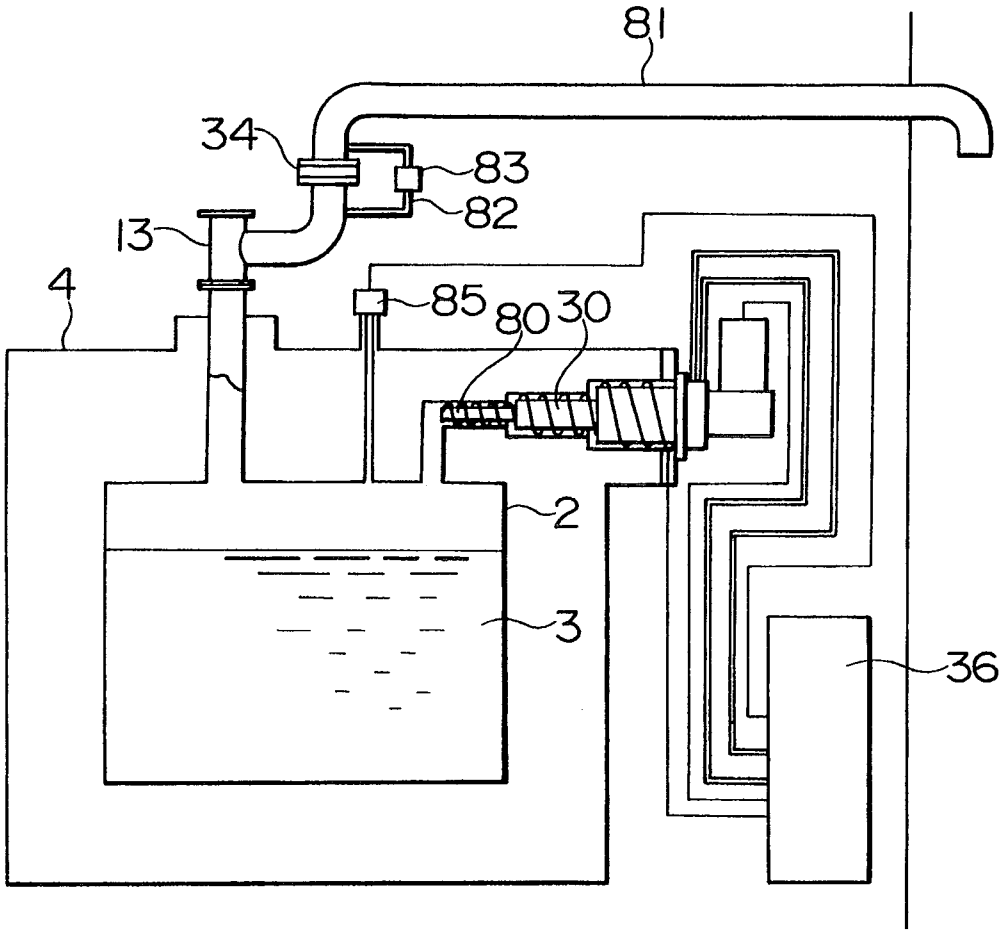
FIG. 16 is a schematic cross-sectional view of the superconducting magnet showing the 14th embodiment of the present invention.

While Embodiment 12 detects differential pressure between the pressure inside the helium chamber 2 and the air pressure in the outdoors by using the differential pressure type pressure sensor 84 and controls the switching on/off of the heater 80 and the freezing cycle rate of the 3-stage cold heat accumulation refrigerator 30 as as to maintain the differential pressure within a predetermined range. Embodiment 14 detects the absolute pressure inside a helium chamber 2 by using a pressue sensor 85, which is pressure detecting means, as shown in FIG. 16, and maintains the absolute pressure within the range 1–1.5 $Kg/cm^2$. This embodiment achieves substantially the same advantages as achieved by Embodiment 12.

EMBODIMENT 15

Embodiment 15 is an embodiment of the superconductive magnet according to aspects 22, 23 of the present invention.

Figure 17:
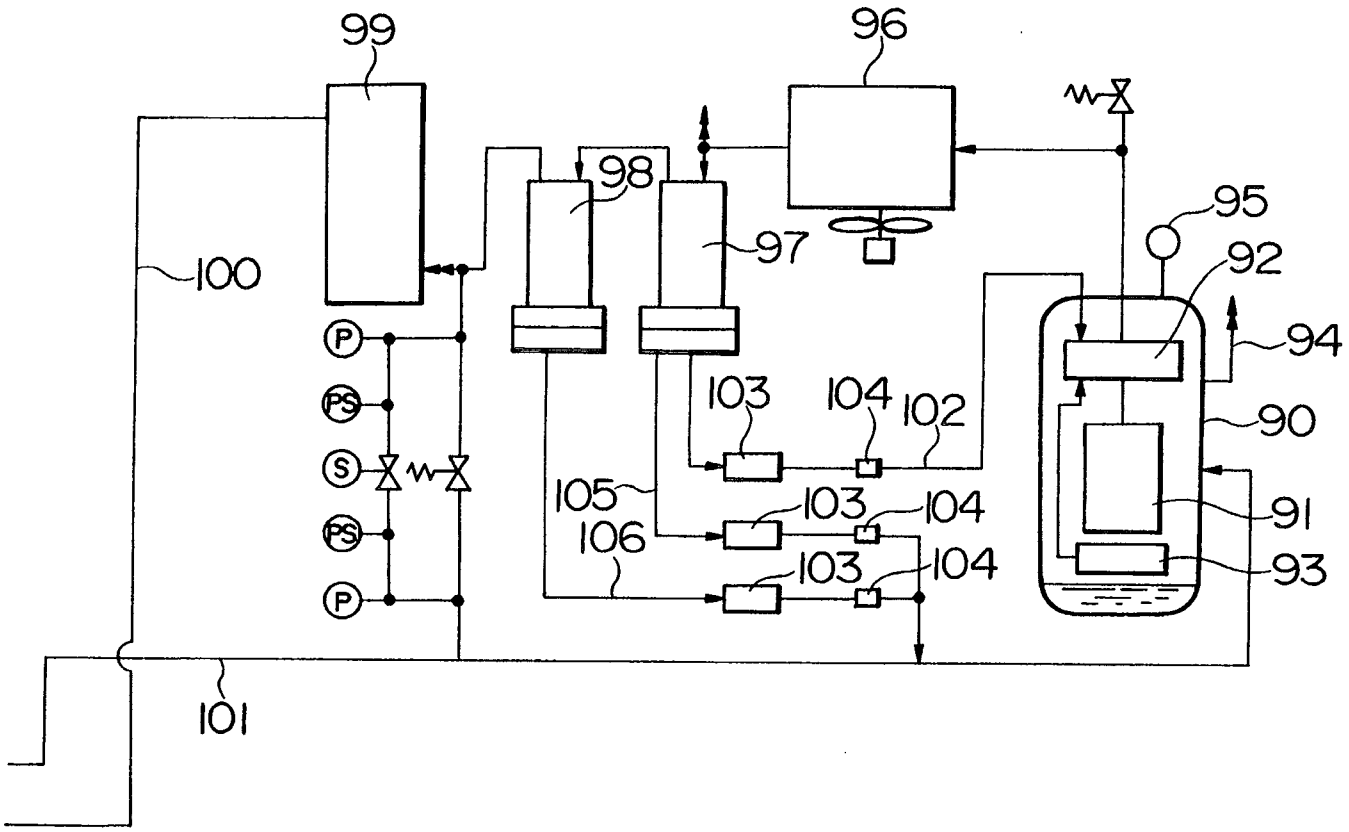
FIG. 17 is a drawing showing a composition of the helium compressing means of the superconducting magnet showing the 15th embodiment of the present invention.
Figure 18:
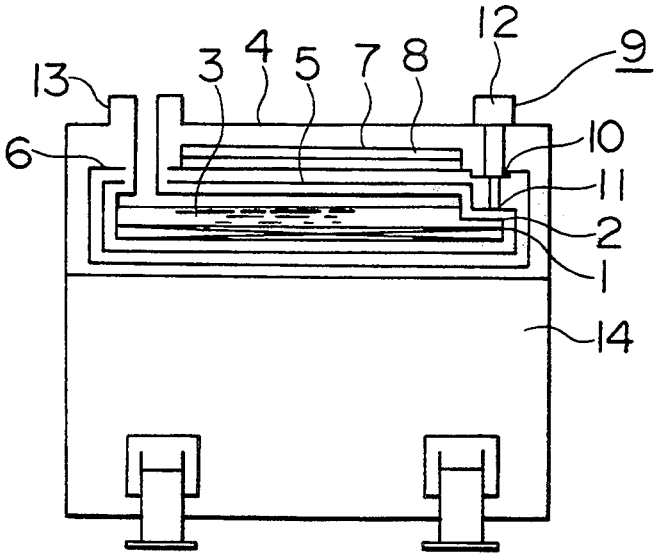
FIG. 18 is a cross-sectional view showing an example of the conventional superconducting magnet.

FIG. 17 illustrates the construction of helium gas compressing means according to Embodiment 15.

The figure shows: low-pressure shell 90 which contains an oil pump 93 and a scroll compressor 92 driven by a motor 91 and is provided with an oil-charging opening 94 and a temperature switch 95; a cooler 96 for cooling high-pressure and high-temperature helium gas discharged from the scroll compressor 92; a rough oil separator 97 for removing oil components contained in the high-pressure helium gas which has been cooled by the cooler 96; a fine oil separator 98 for further removing oil components contained in the high-pressure helium gas which has been let out of the rough oil separator 97; and absorber 99 for absorption-removing oil components contained in the high-pressure helium gas which has been let out from the fine oil separator 98; a gas supplying duct 100 connecting the absorber 99 to a 3-stage cold heat accumulation refrigerator 30 so as to supply helium gas thereto; and a gas returning duct 101 connecting the 3-stage cold heat accumulation refrigerator 30 to the low-pressure shell 90 so as to return low-pressure gas to the low-pressure shell 90.

The figure further shows: an oil injection circuit 102 connecting the rough oil separator 97 to an intermediate-pressure port of the scroll compressor 92 via an oil filter 103 and an orifice member 104 so as to inject the oil removed by the rough oil separator 97 into the scroll compressor 92; and oil returning circuits 105 and 106 connecting the rough oil separator 97 and the fine oil separator 98, respectively, to the gas returning duct 101 via the respective oil filters 103 and orifice members 104 so as to return the oil removed by the rough oil separator 97 and the fine oil separator 98 to the gas returning duct 101.

The operation of Embodiment 15 will be described hereinafter.

High-pressure and high-temperature helium gas compressed by the scroll compressor 92 is sent to the cooler 96, which cools the helium gas.

The thus-cooled high-pressure and low-temperature helium gas is conveyed through the rough oil separator 97 and the fine oil separator 98, which both remove oil components from the helium gas, and then sent to the absorber 99.

The absorber 99 absorbs oil components remaining in the high-pressure helium gas, and supplies the high-pressure helium gas as an operating fluid to the 3-stage cold heat accumulation refrigerator 30 through the gas supplying duct 100.

The low-pressure helium gas let out of the 3-stage cold heat accumulation refrigerator 30 is returned to the low-pressure shell 90 through the gas returning duct 101.

Low-temperature oil removed by the rough oil separator 97 is injected into the intermediate port of the scroll compressor 97 by means of the oil injection circuit 102. Low-temperature oil removed by the rough oil separator 97 and the fine oil separator 98 is returned through the gas returning circuits 105 and 106 to the gas returning duct 101, through which the oil is returned to the low-pressure shell 90 together with helium gas.

As described above, because Embodiment 15 has helium gas compressing means comprising: the low-pressure shell 90, the scroll compressor 92, the oil separator means consisting of the rough oil separator 97 and the fine oil separator 98; the absorber 99, the gas supplying duct 100, the gas returning duct 101, ad the oil injection circuit 102, this embodiment is able to supply the 3-stage cold heat accumulation refrigerator 30 with high-pressure and low-temperature helium gas substantially free from oil components. As a result, Embodiment 15 enhances the freezing performance of the refrigerator,and curbs the temperature increase of the scroll compressor 92 during operation so as to prevent seizing of the scroll compressor 92.

Further, because this embodiment is provided with the gas returning circuits 105, 106 for returning to the gas returning duct 101 the low-temperature oil which has been removed by the oil separator means consisting of the rough oil separator 97 and the fine oil separator 98, the low-temperature oil is returned to the low-pressure shell 90 together with low-pressure helium which has been let out of the 3-stage cold heat accumulation refrigerator 30, thus substantially cooling the oil contained in the low-pressure shell 90.

Although the above embodiments have been described on presumption that the superconductive magnets will be used as superconductive magnet units for magnetic resonance image diagnostic apparatuses, the present invention is not limited to these embodiments. On the contrary, the present invention can be applied to superconductive magnet units for various fields, for example, a magnetically levitating train, synchrotron radiation, and crystal drawing-up apparatuses.

Though the above embodiments each have the 3-stage cold heat accumulation refrigerator 30 positioned in substantially parallel to the axis of the cylindrical superconductive coil 1, the present invention is not limited to such a construction. For example, a superconductive magnet according to the present invention may be constructed by using a race track-shape superconductive coil and positioning a 3-stage cold heat accumulation refrigerator substantially on a plane of the superconductive coil. The thus-constructed superconductive magnet will achieve substantially the same advantages as achieved by the above embodiments.

Though the above embodiments employs the 3-stage cold heat accumulation refrigerators 30 as refrigerators, the present invention is not limited to these embodiments. The superconductive magnet of the present invention may employ an other type of refrigerator, such as a 2-stage cold heat accumulation refrigerator or a 4-stage cold heat accumulation refrigerator, as long as a portion of one of the heat stages of the refrigerator has a freezing capacity sufficient for re-liquefying liquid helium.

Though, according to Embodiment 1, the indium wire 66 is used as a soft metal wire provided between the heat conductor 65 closer to the refrigerator and the heat conductor 64 closer to the refrigerator-mounting cylinder, the soft metal for the wire is not limited to indium but can be an other metal, such as lead, as long as the metal is easy to plastically deform. Further, the shape of the wire should preferably round or spherical so that exersion of a relatively small force on the wire will achieve a relatively large amount of plastic deformation.

Further, although Embodiment 1 employs a natural rubber foam material as the heat insulating member 72 placed between the 3-stage cold heat accumulation refrigerator 30 and the refrigerator-mounting cylinder 51, an other material, such as a polystyrene foam material, may be used as the heat insulating member 72 as long as the material has a low thermal shrinkage rate, a high heat-insulation characteristic and porous structure.

What is claimed is:

1. A superconducting magnet comprising:

a superconducting coil;

a cryogenic refrigerant vessel containing a cryogenic refrigerant for refrigerating said superconducting coil;

a heat-shield surrounding said cryogenic refrigerant vessel; and a vacuum vessel surrounding said heat-shield;

wherein said cryogenic refrigerant vessel is provided with a drawing portion having an end exposed to an atmosphere of a cryogenic refrigerant gas being evaporated in said cryogenic refrigerant vessel;

at least a part of heat stages is exposed to said drawing portion; and a multistage cold heat accumulation refrigerator for reliquefying the cryogenic refrigerant gas being drawn into said drawing portion is mounted substantially in horizontal state on said vacuum vessel.

2. A superconducting magnet comprising:

a superconducting coil;

a cryogenic refrigerant vessel containing a cryogenic refrigerant for cooling said superconducting coil;

a second heat-shield surrounding said cryogenic refrigerant vessel;

a first heat-shield surrounding said second heat-shield;

a vacuum vessel surrounding said first heat shield;

a refrigerator-mounting cylinder provided in said vacuum vessel; and a multistage cold heat accumulation refrigerator being inserted into and fixed to said refrigerator-mounting cylinder such that each heat stage thermally contacts with said refrigerator-mounting cylinder;

wherein a second notch is formed in said second heat-shield;

a first notch portion for exposing said second notch is formed in said first heat-shield;

said first notch thermally contacts with said refrigerator-mounting cylinder with said first heat-shield through a flexible conductor; and said second notch thermally contacts said refrigerator-mounting cylinder with said second heat-shield through a flexible conductor.

3. A superconducting magnet comprising:

a superconducting coil;

a cryogenic refrigerant vessel containing a cryogenic refrigerant for refrigerating said superconducting coil;

a second heat-shield surrounding said cryogenic refrigerant vessel;

a first heat-shield surrounding said second heat-shield;

a vacuum vessel surrounding said first heat-shield;

a refrigerator-mounting cylinder provided in said vacuum vessel; and a multistage cold heat accumulation refrigerator inserted into and fixed to said refrigerator-mounting cylinder such that a part of heat stages thereof thermally contacts with said refrigerator-mounting cylinder;

wherein a second notch is formed in said second heat-shield;

a first notch is formed in said first heat-shield to expose said second notch;

a radiation cover for sealing said first and second notch is provided;

said refrigerator-mounting cylinder and said first heat-shield are thermally coupled through a flexible conductor at said first notch;

said refrigerator-mounting cylinder and said second heat-shield are thermally coupled through a flexible conductor at said second notch; and said first and second notches are sealed by said radiation cover.

4. A superconducting coil comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield;

a refrigerator-mounting cylinder having an end being exposed to an atmosphere of a cryogenic refrigerant gas being evaporated in said cryogenic refrigerant vessel and the other end being mounted in substantially horizontal state on said vacuum vessel; and a multistage cold heat accumulation refrigerator having heat stages at least a part of which reliquefies the cryogenic refrigerant gas having been drawn into said refrigerator-mounting cylinder;

wherein a thermally insulating filler is filled in a space between said multistage cold heat accumulation refrigerator and said refrigerator-mounting cylinder.

5. A superconducting magnet comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield;

a refrigerator-mounting cylinder having one end being exposed to an atmosphere of the cryogenic refrigerant gas being evaporated in said cryogenic refrigerant vessel and the other end being mounted substantially in horizontal state on said vacuum vessel; and a multistage cold heat accumulation refrigerator inserted into and fixed to said refrigerator-mounting cylinder and having heat stages at least a part of which reliquefies the cryogenic refrigerant gas having been drawn into said refrigerator-mounting cylinder;

wherein a thermally insulating filler to be filled in a space between said multistage cold heat accumulation refrigerator and said refrigerator-mounting cylinder is attached to said multistage cold heat accumulation refrigerator.

6. A superconducting coil comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield;

a multistage heat accumulation refrigerator composed of: a multistage cylinder having a plurality of heat stages; and a multistage displacer slidably mounted in said cylinder; and a refrigerator-mounting cylinder mounted on said vacuum vessel for holding said multistage heat accumulation refrigerator having been inserted thereinto;

wherein a refrigerator-side thermal conductor having a tapered surface is provided in each of the heat stages of said multistage heat accumulation refrigerator;

a cylinder-side thermal conductor is having a tapered surface is provided at an inner wall surface of said refrigerator-mounting cylinder being opposed to said refrigerator-side thermal conductor; and a soft metal is held between said refrigerator-side thermal conductor and said cylinder-side thermal conductor.

7. A superconducting coil comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield;

a multistage cryogenic refrigerant refrigerator composed of: a multistage cylinder having a plurality of heat stages; and a multistage displacer slidably mounted in said cylinder; and a refrigerator-mounting cylinder mounted in said vacuum vessel for holding said multistage cold heat accumulation refrigerator being inserted thereinto;

wherein a refrigerator-side elastic thermal conductor is provided at each heat stage of said multistage cold heat accumulation refrigerator;

a cylinder-side thermal conductor is provided at an inner wall surface of said refrigerator-mounting cylinder being opposed to said refrigerator-side elastic thermal conductor; and a soft metal is held between said refrigerator-side elastic thermal conductor and said cylinder side thermal conductor.

8. A superconducting magnet comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield;

a multistage cold heat accumulation refrigerator composed of: a multistage cylinder having a plurality of heat stages; and a multistage displacer slidably mounted in said cylinder; and a refrigerator-mounting cylinder mounted in said vacuum vessel for holding said multistage cold heat accumulation refrigerator having been inserted thereinto;

wherein a refrigerator-side thermal conductor having a knurled tapered surface at each of the heat stages of said multistage cold heat accumulation refrigerator;

a cylinder-side thermal conductor having a tapered surface is provided at the inner wall surface of said refrigerator-mounting cylinder opposed to said refrigerator-side thermal conductor; and a soft metal is held between said refrigerator-side thermal conductor and said cylinder-side thermal conductor.

9. A superconducting magnet comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield;

a multistage cold heat accumulation refrigerator having a flange portion; and a refrigerator-mounting cylinder having a mounting flange portion;

wherein an air-tight seal member is provided between an inner periphery surface of said mounting-flange portion and an outer periphery surface of said flange portion;

said flange portion is screwed through an elastic member to said mounting flange; and said multistage cold heat accumulation refrigerator is elastically and slidably held on said refrigerator-mounting cylinder.

10. A superconducting magnet comprising:

a superconducting coil;

a cryogenic refrigerant vessel containing a cryogenic refrigerant for cooling said superconducting coil;

a heat shield surrounding said cryogenic refrigerant vessel;

a vacuum vessel surrounding said heat shield; and a multistage cold heat accumulation refrigerator having heat stages at least a part of which is exposed to an atmosphere of a cryogenic refrigerant gas being evaporated in said cryogenic refrigerant vessel for reliquefying the cryogenic refrigerant gas;

wherein an expanded heat transmitting surface is formed at the outer periphery surface of the heat stage for reliquefying the cryogenic refrigerant.

11. A superconducting magnet comprising:

a superconducting magnet;

a cryogenic refrigerant vessel containing a cryogenic refrigerant for refrigerating said superconducting coil;

a heat shield surrounding said cryogenic refrigerant vessel;

a vacuum vessel surrounding said heat shield;

a drawing portion provided in said cryogenic refrigerant vessel and having an end to be exposed to an atmosphere of a cryogenic refrigerant gas being evaporated in said cryogenic refrigerant vessel; and a multistage cold heat accumulation refrigerator having a heat stage at least a part of which is exposed to said drawing portion for reliquefying the very low temperature coolant gas being drawn into said drawing portion;

wherein at least a part of a heat accumulator of said multistage cold heat accumulation refrigerator is mounted in said drawing portion.

12. A superconducting magnet, as set forth in claim 11, further comprising:

a plurality of short iron rings provided on the inner wall surface of the drawing portion at a predetermined spacing so as to surround the multistage cold heat accumulation refrigerator.

13. A superconducting magnet comprising:

a superconducting magnet;

a cryogenic refrigerant vessel containing a cryogenic refrigerant for refrigerating said superconducting coil;

a heat shield surrounding said cryogenic refrigerant vessel;

a vacuum vessel surrounding said heat shield;

a drawing portion provided in said cryogenic refrigerant vessel and having an end to be exposed to an atmosphere of a cryogenic refrigerant gas being evaporated in said cryogenic refrigerant vessel; and a multistage cold heat accumulation refrigerator having heat stages at least a part of which is exposed to said drawing portion for reliquefying the cryogenic refrigerant gas being drawn into said drawing portion;

wherein a hollow cylindrical magnetic shield made of magnetic member is mounted to support outer side of said drawing portion to surround a part of the cool heat accumulator of said multistage cold heat accumulation refrigerator.

14. A superconducting magnet, as set forth in claim 13, further comprising:

a plurality of short iron rings provided on the inner wall surface of the drawing portion at a predetermined spacing so as to surround the multistage cold heat accumulation refrigerator.

15. A superconducting magnet comprising:

a superconducting magnet;

a cryogenic refrigerant vessel containing a cryogenic refrigerant for refrigerating said superconducting coil;

a heat shield surrounding said cryogenic refrigerant vessel;

a vacuum vessel surrounding said heat shield;

a refrigerator-mounting cylinder having an end being exposed to an atmosphere of a cryogenic refrigerant gas being evaporated in said cryogenic refrigerant vessel and the other end being mounted horizontally in said vacuum vessel; and a multistage cold heat accumulation refrigerator being inserted into and fixed to said refrigerator-mounting cylinder and having heat stages at least a part of which reliquefies the cryogenic refrigerant gas being drawn into said refrigerator-mounting cylinder;

wherein a thermally insulating filler is filled in a space between said multistage heat accumulation refrigerator and said refrigerator-mounting cylinder so as to surround at least a part of a cold heat accumulator of said multistage cold heat accumulation refrigerator.

16. A method for assembling a superconducting magnet comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield;

a refrigerator composed of a multistage cylinder having heat stages and a multistage displacer slidably provided in said cylinder; and a refrigerator-mounting cylinder mounted in said vacuum vessel for holding said refrigerator being inserted thereinto;

wherein said refrigerator is inserted into said refrigerator-mounting cylinder;

said refrigerator is screwed into and fixed to said refrigerator-mounting cylinder such that said heat stages and said refrigerator-mounting cylinder are thermally contacted; and said refrigerator is further tightly screwed into said refrigerator-mounting cylinder after said refrigerator is refrigerated.

17. A superconducting magnet comprising:

a superconducting coil;

a cryogenic refrigerant vessel containing a cryogenic refrigerant for refrigerating said superconducting coil;

a second heat-shield surrounding said cryogenic refrigerant vessel;

a first heat-shield surrounding said second heat-shield;

a vacuum vessel surrounding said first heat shield; and a three-stage heat accumulation refrigerator mounted substantially in horizontal state;

wherein said three-stage cold heat accumulation refrigerator has a refrigerating capacity of: reaching temperature of a first heat stage, 50–80 K.; reaching temperature of a second heat stage, 10–20 K.; and a reaching temperature of a third heat stage, 2–4.5 K.;

said first and second heat shields are refrigerated at said first and second heat stages respectively; and the cryogenic refrigerant gas being evaporated in said cryogenic refrigerant vessel is reliquefied at said third heat stage.

18. A superconducting magnet comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield; and a refrigerator for refrigerating said heat-shield;

wherein a pressure difference detecting means for detecting a difference between a pressure in said cryogenic refrigerant vessel and an atmospheric pressure; and said difference pressure is controlled to be 0–0.5 Kg/cm.

19. A superconducting magnet comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield; and a refrigerator for refrigerating said heat-shield;

wherein a pressure detecting means for detecting an absolute pressure in said cryogenic refrigerant vessel; and said absolute pressure is controlled to be 1–1.5 Kg/cm.

20. A superconducting magnet comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield;

a helium gas compressing means provided at a constant temperature portion; and a refrigerator for making said helium gas compressed by said helium gas compressing means be operating fluid for rerigerating said heat shield;

wherein said helium gas compressing means is composed of;

a low pressure shell;

a scroll compressor provided in said low pressure shell;

a refrigerating means for refrigerating high-pressure helium gas being output from said scroll compressor;

an oil separator for eliminating oil components contained in the high-pressure helium gas refrigerated in said refrigerating member;

a adsorber for adsorbing the oil components contained in the high-pressure helium gas output from said oil separator;

a gas supply duct for supplying the high-pressure helium gas output from said adsorber to said refrigerator;

a gas return duct for returning low-pressure helium gas from said refrigerator to said low pressure shell; and an oil injection circuit for injecting the oil separated by said oil separator into an intermediate pressure boat of said scroll compressor;

21. A superconducting magnet comprising:

a superconducting coil;

a cryogenic refrigerant vessel containing a cryogenic refrigerant for refrigerating said superconducting coil;

a heat-shield surrounding said cryogenic refrigerant vessel;

a vacuum vessel surrounding said heat-shield;

a helium gas compressing means provided at a constant temperature portion; and a refrigerator for making said helium gas compressed by said helium gas compressing means be operating fluid for refrigerating said heat shield;

wherein said helium gas compressing means is composed of:

a low pressure shell;

a scroll compressor provided in said low pressure shell;

a refrigerating means for refrigerating high-pressure helium gas being output from said scroll compressor;

an oil separator for eliminating oil components contained in the high-pressure helium gas refrigerated in said refrigerating member;

a adsorber for adsorbing the oil components contained in the high-pressure helium gas output from said oil separator;

a gas supply duct for supplying the high-pressure helium gas output from said adsorber to said refrigerator;

a gas return duct for returning low-pressure helium gas from said refrigerator to said low pressure shell; and an oil return circuit for returning the oil separated in said oil separator to said gas return duct.

* * * * *